US008191884B2

(12) United States Patent
Sato et al.

(10) Patent No.: US 8,191,884 B2
(45) Date of Patent: Jun. 5, 2012

(54) SHEET PROCESSING APPARATUS AND IMAGE FORMING APPARATUS

(75) Inventors: Koki Sato, Tsukubamirai (JP); Satoshi Iwama, Minami-alps (JP)

(73) Assignee: Canon Finetech Inc., Misato-shi (JP)

( * ) Notice: Subject to any disclaimer, the term of this patent is extended or adjusted under 35 U.S.C. 154(b) by 71 days.

(21) Appl. No.: 12/873,164

(22) Filed: Aug. 31, 2010

(65) Prior Publication Data

US 2011/0062646 A1 Mar. 17, 2011

(30) Foreign Application Priority Data

Sep. 11, 2009 (JP) ..... 2009-211126
Jul. 16, 2010 (JP) ..... 2010-161369

(51) Int. Cl.
*B65H 37/04* (2006.01)

(52) U.S. Cl. ..... 270/58.08; 270/58.07

(58) Field of Classification Search ..... 270/37, 270/58.07, 58.08, 58.09, 58.11; 399/408, 399/410

See application file for complete search history.

(56) References Cited

U.S. PATENT DOCUMENTS

| | | | | |
|---|---|---|---|---|
| 5,382,011 | A * | 1/1995 | Tani | 270/37 |
| 5,778,300 | A * | 7/1998 | Murakami et al. | 399/403 |
| 6,227,530 | B1 * | 5/2001 | Namba et al. | 270/58.09 |
| 7,134,659 | B2 | 11/2006 | Sato et al. | |
| 7,300,046 | B2 * | 11/2007 | Sugiyama et al. | 270/58.17 |
| 7,693,480 | B2 * | 4/2010 | Nomura et al. | 399/410 |
| 2009/0189327 | A1 * | 7/2009 | Sato et al. | 270/58.08 |

FOREIGN PATENT DOCUMENTS

| | | |
|---|---|---|
| JP | 2089772 | 3/1990 |
| JP | 2005-132609 | 5/2005 |
| JP | 2005-132635 | 5/2005 |

* cited by examiner

*Primary Examiner* — Leslie A Nicholson, III
(74) *Attorney, Agent, or Firm* — Fitzpatrick, Cella, Harper & Scinto

(57) ABSTRACT

The present invention provides a sheet processing apparatus and an image forming apparatus in which even if the apparatus includes a gripping apparatus gripping one side of a sheet bundle to be stapled, the sheet bundle can be stapled in a portion thereof in which the gripping apparatus is located. A gripper unit is moved in a direction crossing one side of sheets and placed in a discharge position in which the gripper unit discharges the gripped sheets and in a coupling position where the gripper unit is coupled to a staple unit. The gripper unit is thus moved in the same direction as that in which the staple unit coupled to the gripper unit at the coupling position moves. Thus, the staple unit can be moved to a stapling position without the need to ensure a retract space.

9 Claims, 22 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and in particular, to a configuration for moving a stapling apparatus to a position where a stapling process is to be carried out.

2. Description of the Related Art

In the prior art, image forming apparatuses such as copiers, printers, and facsimile machines sometimes include a sheet processing apparatus which sequentially receives sheets such as copy sheets on which images have been formed and which then selectively carries out a stapling process, a punching process, or the like on the sheets. When the image forming apparatus includes such a sheet processing apparatus, time and effort required for processes such as stapling and punching which are carried out on sheets with images formed thereon can be reduced.

For example, to carry out a stapling process, the sheet processing apparatus includes a processing tray on which sheets to be stapled are stacked, a stapling apparatus that staples a sheet bundle on the processing tray, and a housing tray onto which the sheet bundle stapled on the processing tray are discharged.

Some such sheet processing apparatuses can carry out what is called a multi-stapling process including an end stapling mode in which one of the opposite end corners of one side of the sheet bundle is selectively stapled and a two-position stapling mode in which one side of the sheet bundle is stapled at two positions (see Japanese Patent Application Laid-Open No. 2005-132635). In the sheet processing apparatus, in the end stapling mode, the stapling apparatus is moved to a stapling position at the selected end to staple the sheet bundle. Furthermore, in the two-position stapling mode, the stapling apparatus is moved along one side of the sheet bundle to a first stapling position to staple the sheet bundle and then moved to a second stapling position to staple the sheet bundle again. The first and second stapling positions in the two-position stapling mode are pre-specified according to the sheet size.

Here, in some cases, when a stapling process is carried out, the sheet bundle stacked on the processing tray is moved to a stapling position by conveying means before the stapling apparatus staples the sheet bundle. Some sheet processing apparatuses include, for example, a gripping apparatus that grips sheets, as conveying means for moving the sheet bundle to the stapling position. Thus, the gripping apparatus gripping one side of the sheet bundle is moved to move the sheet bundle to the stapling position (see Japanese Patent Application Laid-Open No. H02-089772). Compared to a scheme in which the sheet bundle being pressed by a pressing member is conveyed to the stapling position, the above-described grip conveying scheme undergoes less misalignment in the sheet bundle. Furthermore, a conveying scheme is known in which one side of the sheet bundle is gripped by a gripping apparatus and in which the gripping apparatus is moved to convey the sheet bundle to a housing tray (see Japanese Patent Application Laid-Open No. 2005-132609).

In a sheet processing apparatus using such a grip conveying scheme, in the two-position stapling mode, the gripping apparatus is located on one side of the sheet bundle to be stapled. Thus, the stapling apparatus is prevented from moving along this side of the sheet, thus preventing the sheet bundle from being stapled. That is, the conventional sheet processing apparatuses fail to staple the portion of the sheet bundle where the gripping apparatus is located.

Thus, an object of the present invention is to provide a sheet processing apparatus and an image forming apparatus in which even when the apparatus includes a gripping apparatus that grips one side of the sheet bundle to be stapled, the portion of the sheet bundle where the gripping apparatus is located can be stapled.

SUMMARY OF THE INVENTION

The present invention provides a sheet processing apparatus including a processing tray on which sheets to be conveyed in a predetermined discharge direction are stacked, a stapling apparatus stapling an upstream side, in the discharge direction, of the sheets stacked on the processing tray, a gripping apparatus gripping one side of the sheets stapled by the stapling apparatus, a first moving mechanism moving the stapling apparatus in a width direction crossing the discharge direction, along the upstream side of the sheets stacked on the processing tray, and a second moving mechanism moving the gripping apparatus in the discharge direction to move the sheets in the discharge direction, wherein if the stapling apparatus staples the sheets in a movement area for the gripping apparatus in the discharge direction, the gripping apparatus is retracted in the width direction, and if the stapling apparatus staples the sheets outside the movement area, the gripping apparatus avoids retracting in the width direction.

According to the present invention, when the stapling apparatus moves to the movement area through which the gripping apparatus moves in the discharge direction, to carry out a stapling process, the gripping apparatus retracts in the width direction so as not to disturb the movement of the stapling apparatus to the movement area. Thus, if the portion in which the gripping apparatus is located is stapled, the stapling apparatus can be moved to the stapling position without the need for a special retract space for the gripping apparatus.

Further features of the present invention will become apparent from the following description of exemplary embodiments with reference to the attached drawings.

DESCRIPTION OF THE EMBODIMENTS

Figure 1:
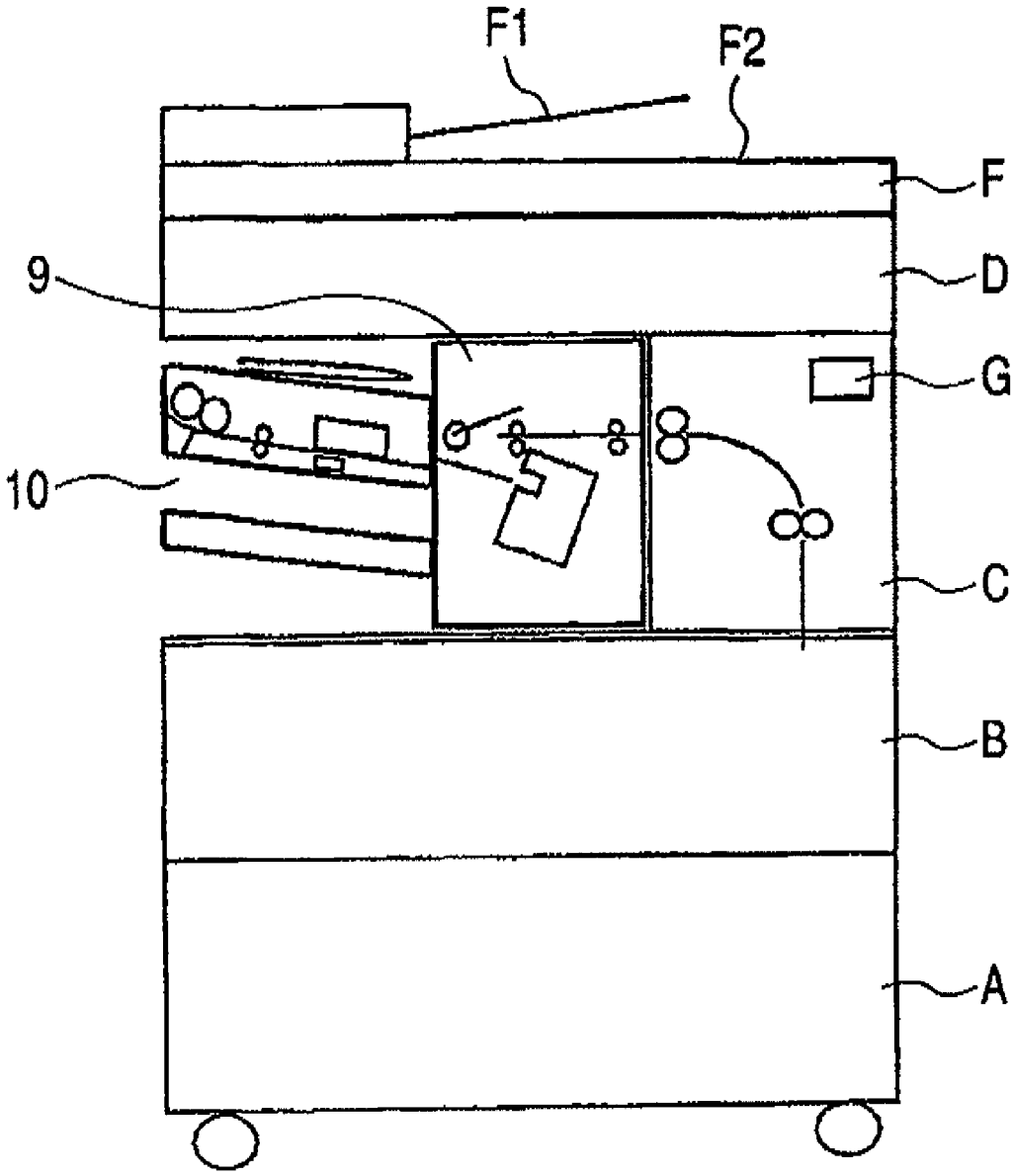
FIG. 1 is a diagram schematically illustrating the configuration of an image forming apparatus including a sheet processing apparatus according to an exemplary embodiment of the present invention.

An exemplary embodiment of the present invention will be described below with reference to the drawings. FIG. 1 is a diagram schematically illustrating the configuration of an image forming apparatus with a sheet processing apparatus according to the exemplary embodiment of the present invention. In FIG. 1, the image forming apparatus includes a sheet feeding apparatus A, an image forming apparatus main body B with an image forming section, a sheet processing apparatus C, a document reading apparatus D, and a document conveying apparatus F.

Here, the document conveying apparatus F sequentially conveys documents set on a document tray F1 to a platen (not illustrated in the drawings) provided on the top surface of the document reading apparatus D and then out onto a sheet discharging tray F2. The image reading apparatus D uses reading means including a lamp, a plurality of mirrors and lenses, and an image sensor (not illustrated in the drawings) to read an image from a document passed over the platen by the document conveying apparatus F. The image forming apparatus main body B includes an exposure section (not illustrated in the drawings) outputting laser light in response to image signals read by the image reading apparatus D and a photosensitive drum that is irradiated with laser light to form an electrostatic latent image on the surface thereof. Furthermore, the image forming apparatus main body B includes a developing member that develops the electrostatic latent image on the photosensitive drum to form a toner image, a transfer section that transfers the toner image formed on the photosensitive drum, to a sheet, and a fixing section that fixes the toner image transferred to the sheet. The exposure section, the photosensitive drum, the developing member, and fixing section are included in an image forming section forming an image on the sheet.

The sheet feeding apparatus A includes a plurality of cassettes (not illustrated in the drawings) to convey sheets housed in any of the cassettes to the transfer section. The sheet processing apparatus C is located between the image forming apparatus main body B and the document reading apparatus D. The sheet processing apparatus C includes a processing section 9 with a stapling apparatus at one end thereof in the horizontal direction and a housing section 10 provided at the other end and in which sheets are housed. The housing section 10 is positioned in the space between the image forming apparatus main body B and the document reading apparatus D. That is, the image forming apparatus according to the present exemplary embodiment has what is called an in-body carry-out function in which processed sheets are discharged and housed in the space between the image forming apparatus main body B and the document reading apparatus D.

In the image forming apparatus configured as described above, when the document reading apparatus D reads a document image and forms the read image on a sheet, first, the document conveying apparatus F passes the document over the platen. At this time, the image reading apparatus D allows the lamp to emit light so that the emitted light is reflected by the document surface. The image reading apparatus D then guides the reflected light to the image sensor via the plurality of mirrors and lenses to read the image. Thereafter, image data from the document read by the image sensor is subjected to predetermined image processing, and the processed data is transferred to the exposure section of the image forming apparatus main body B.

Then, in the image forming apparatus main body B, the exposure section outputs laser light corresponding to the image signal. The laser light is emitted onto the photosensitive drum while being scanned by a polygon mirror. As a result, an electrostatic latent image corresponding to the scanned laser light is formed on the photosensitive drum. Thereafter, the electrostatic latent image formed onto the photosensitive drum is developed by the developing member so as to be visualized as a toner image.

On the other hand, the sheet on which an image is to be formed is conveyed from any one of a plurality of cassettes in the sheet feeding apparatus A to the transfer section. The transfer section transfers the visualized toner image on the photosensitive drum to the sheet. Thereafter, the sheet with the toner image transferred thereto is subjected to a fixing process by the fixing section to fix the toner image. Then, the sheet having passed through the fixing section is conveyed to the sheet processing apparatus C. Thereafter, the processing section 9 carries out processing such as stapling and folding on the resultant sheets, which are then discharged to the housing section 10.

Figure 2:
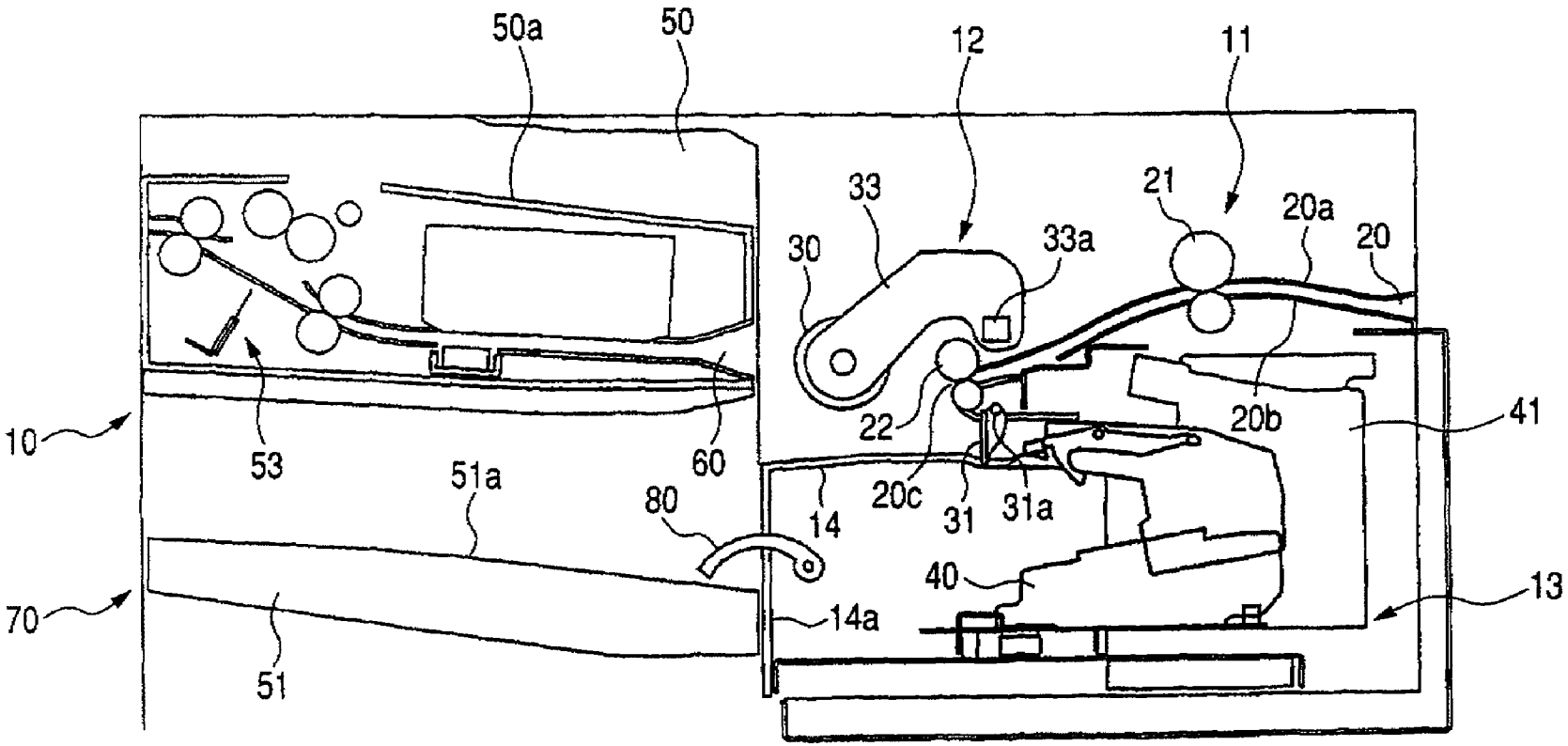
FIG. 2 is a sectional view illustrating the configuration of the sheet processing apparatus.

FIG. 2 is a sectional view illustrating the configuration of the sheet processing apparatus C. As illustrated in FIG. 2, the sheet processing apparatus C includes the housing section 10, a conveying section 11 that receives a sheet from the image processing apparatus main body B and conveys the sheet, a processing tray 14 that processes the sheet conveyed by the conveying section 11, and an alignment section 12 with which sheets on the processing tray 14 are aligned. Furthermore, the sheet processing apparatus C includes a staple gripper section 13 that staples the sheets conveyed in the predetermined discharge direction, stacked on the processing tray, and then aligned with the alignment section 12.

The conveying section 11 includes paired guide plates 20*a* and 20*b* that guide the sheet, a conveying path 20 that is continuous with a sheet discharging port of the image forming apparatus main body B, and a conveying roller pair 21 that conveys the sheet along the conveying path 20. A carry-out roller pair 22 is provided at a carry-out port 20*c* of the conveying path 20 to sequentially carry sheets out to the processing tray 14, located below the conveying path 20. In the exemplary embodiment, when the carry-out roller pair 22 carries a sheet out, the sheet is loaded so as to bridge between the processing tray 14 and the loading surfaces of a first stack tray 50 and a second stack tray which are provided in the housing section 10. Predetermined processing is then carried out on the sheet.

The first and second stack trays 50 and 51, corresponding to a sheet stacking section, include sheet loading surfaces 50*a* and 51*a*, respectively. The first and second stack trays 50 and 51 are supported by a frame 14*a* included in the processing tray 14 so as to be freely raised and lowered in the vertical direction. A saddle unit 53 is provided below the sheet loading surface 50*a* of the first stack tray 50. A sheet bundle stacked on the processing tray 14 is selectively folded by the saddle unit 53 and then housed on the sheet loading surface 50*a* of the first stack tray 50.

Thus, the folded sheet bundle from the saddle unit 53 and a sheet bundle stapled at an end thereof or at two positions thereof by a staple unit 41 are housed on the first stack tray 50. Furthermore, a sheet bundle stapled at an end thereof or at two positions thereof by the staple unit 41 is housed on the sheet loading surface 51*a* of the second stack tray 51. Of course, a sheet bundle that is not stapled or folded can be housed on the first and second stack trays 50 and 51.

The alignment section 12 includes a stopper member 31 with which one end of sheets carried out onto the processing tray 14 is aligned, and a shift roller 30 that contacts the top surface of sheets carried out onto the processing tray to convey the sheets in a width direction crossing the sheet discharging direction of the carry-out roller pair 22. Furthermore, the alignment section 12 includes an alignment member 32 (32*a* and 32*b*) illustrated in FIG. 3 and with which a widthwise end of the sheets conveyed by the shift roller 30 in the width direction comes into abutting contact.

As illustrated in FIG. 2, a stopper member 31 is configured to be pivotally movable around a support shaft 31*a* serving as a support point. The stopper member 31 is pivotally movable to an aligned position where the stopper member 31 brings into abutting contact with the trailing ends of sheets (the upstream ends of the sheets in the sheet discharging direction) to regulate the rear end position of the sheets and where the stopper member 31 is perpendicular to the processing tray 14, and to a retract position where the stopper member 31 is located substantially horizontally with respect to the processing tray 14. Furthermore, the shift roller 30 is rotated by a feed motor (not illustrated in the drawings) that can rotate forward and backward. The shift roller 30 is rotatably supported at one end of an arm member 33 that is pivotally movable vertically around a support shaft 33*a* serving as a support point and having a polygonal cross section. The shift roller 30 moves to a contact position where as a result of a pivotally moving operation, the arm member 33 contacts the top surface of sheets on the processing tray and to a retract position where the shift roller 30 is retracted from the sheet top surface. Moreover, the arm member 33 is configured to be movable in the width direction along the support shaft 33*a*. Movement of the arm member 33 causes the shift roller 30 to slide.

In the alignment section 12 configured as described above, when a sheet is carried out onto the processing tray 14, first, the arm member 33 pivotally moves downward. The shift roller 30 correspondingly moves from the retract position to the contact position to rotate, thus conveying the sheet in a direction opposite to the sheet discharging direction, that is, toward the stopper member 31. This rotation of the shift roller 30 brings the sheet into abutting contact with the stopper member 31 in the aligned position. Thus, an end of the sheet in a feeding direction, the trailing end of the sheets is aligned with the stopper member 31.

When the trailing end of the sheets is aligned, the shift roller 30 is stopped. Thereafter, the arm member 33 is moved with a shift motor (not shown) in the width directions, so that the shift roller 30 is slid toward the alignment member 32 while in contact with the sheet top surface. Here, the shift roller 30 is formed of a high-friction member such as urethane rubber. Thus, when the shift roller 30 is slid, the sheet follows the sliding movement and slides toward the alignment member 32. Thereafter, the arm member 33 (shift roller 30) slides until one widthwise end of the sheet brings into abutting contact with the alignment member 32, and is stopped. Thus, the widthwise ends of the sheet are aligned with the alignment member 32.

Figure 3:
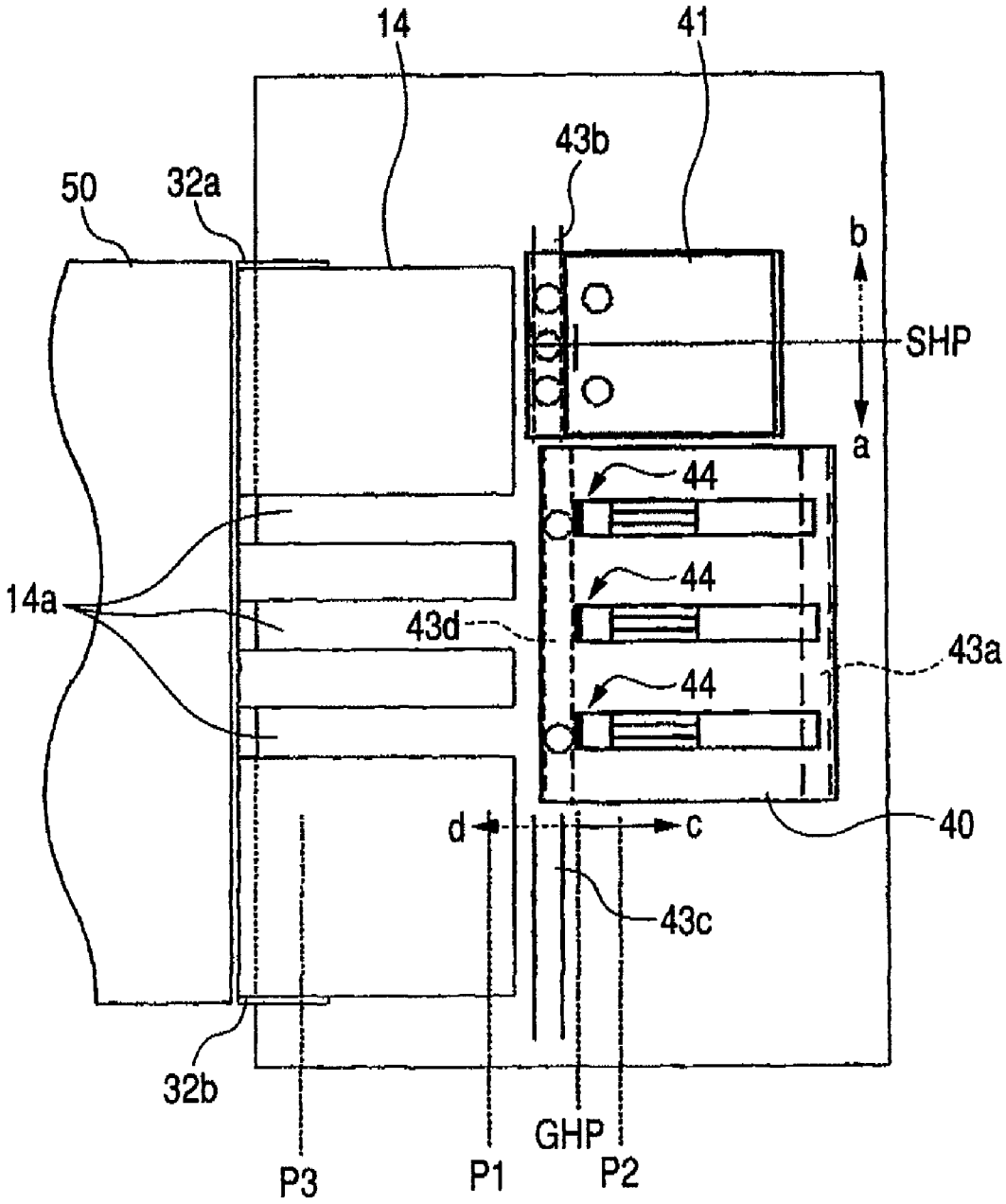
FIG. 3 is a plan view of the sheet processing apparatus.

The sheet processing apparatus C in the exemplary embodiment has a plurality of stapling modes, a first end stapling mode in which the sheets are stapled at one widthwise end, a second end stapling mode in which the sheets are stapled at the other end opposite to the one widthwise end, and a two-position stapling mode in which one side of the sheets is stapled at two positions. In the first end stapling mode and the two-position stapling mode, the shift roller 30 brings sheets into abutting contact with an alignment member 32*a* provided in the back of the apparatus as illustrated in FIG. 3 so as to achieve the alignment of the sheets in width directions. Here, the "back of the apparatus" means an area located farther from the widthwise center of sheets conveyed to the sheet processing apparatus C with respect to the front of the sheet processing apparatus C corresponding to the state illustrated in FIG. 1 (the width direction is the same as the direction crossing the sheet discharging direction). The image forming apparatus main body B allows the sheets to be conveyed to the sheet processing apparatus C with reference to the center. On the other hand, in the second end stapling mode, the sheets are brought into abutting contact with an alignment member 32*b* provided closer to the front of the apparatus to align the sheets in the width direction.

Then, when the alignment operation with respect to the trailing end or one widthwise end of the sheets is finished, the arm member 33 moves pivotally upward to move the shift roller 30 to the retract position, located away from the sheet top surface. Thereafter, the arm member 33 and the shift roller 30 moves along the support shaft 33*a* to an initial position (home position) corresponding substantially to the widthwise center of the processing tray 14. When the next sheet is carried out onto the processing tray 14, a similar alignment operation is performed.

As illustrated in FIG. 2, the staple gripper section 13 includes a gripper unit 40 that grips and moves a sheet bundle aligned on the processing tray, and a staple unit 41 that staples the sheet bundle moved to a staple process position by the gripper unit 40.

Here, the gripper unit 40, a gripping apparatus that grips one side of the sheets to be stapled, is configured to be movable in the directions of arrow (c) and arrow (d) in FIG. 3 (the sheet discharging direction and the direction opposite to the sheet discharging direction). To allow the sheet bundle to be discharged, the gripper unit 40 moves to a sheet discharging position illustrated at P3. To grip the trailing end of the sheet bundle, the gripper unit 40 moves to a grip position illustrated at P1, integrally with a fourth guide rail 43*d* described below. To allow the sheet bundle to be stapled, the gripper unit 40 moves to a staple process position illustrated at GHP, integrally with the fourth guide rail 43*d*.

Moreover, to allow the sheet bundle to be stapled at two positions, the gripper unit 40 moves to a unit coupling position P2 where the gripper unit 40 is coupled to the staple unit 41 described below. In the exemplary embodiment, the staple process position GHP for the gripper unit 40 is the same as the home position for the gripper unit 40. Furthermore, the sheet discharging position P3, to which the gripper unit 40 moves, is the same as a rail coupling position where the gripper unit 40 moves to couple rails together described below. For convenience, the staple process position and the home position as well as the sheet discharging position P3 and the rail coupling position are selectively used depending on the purpose, function, and operation. The position of the gripper unit 40 illustrated in FIG. 3 is GHP.

The staple unit 41 is configured to be movable in the directions of arrows (a) and (b) (width direction) in FIG. 3, and moves to a home position and a staple position determined depending on each stapling mode and each sheet size. Furthermore, SHP in FIG. 3 denotes a staple portion (center line) of the staple unit 41.

Figure 4:
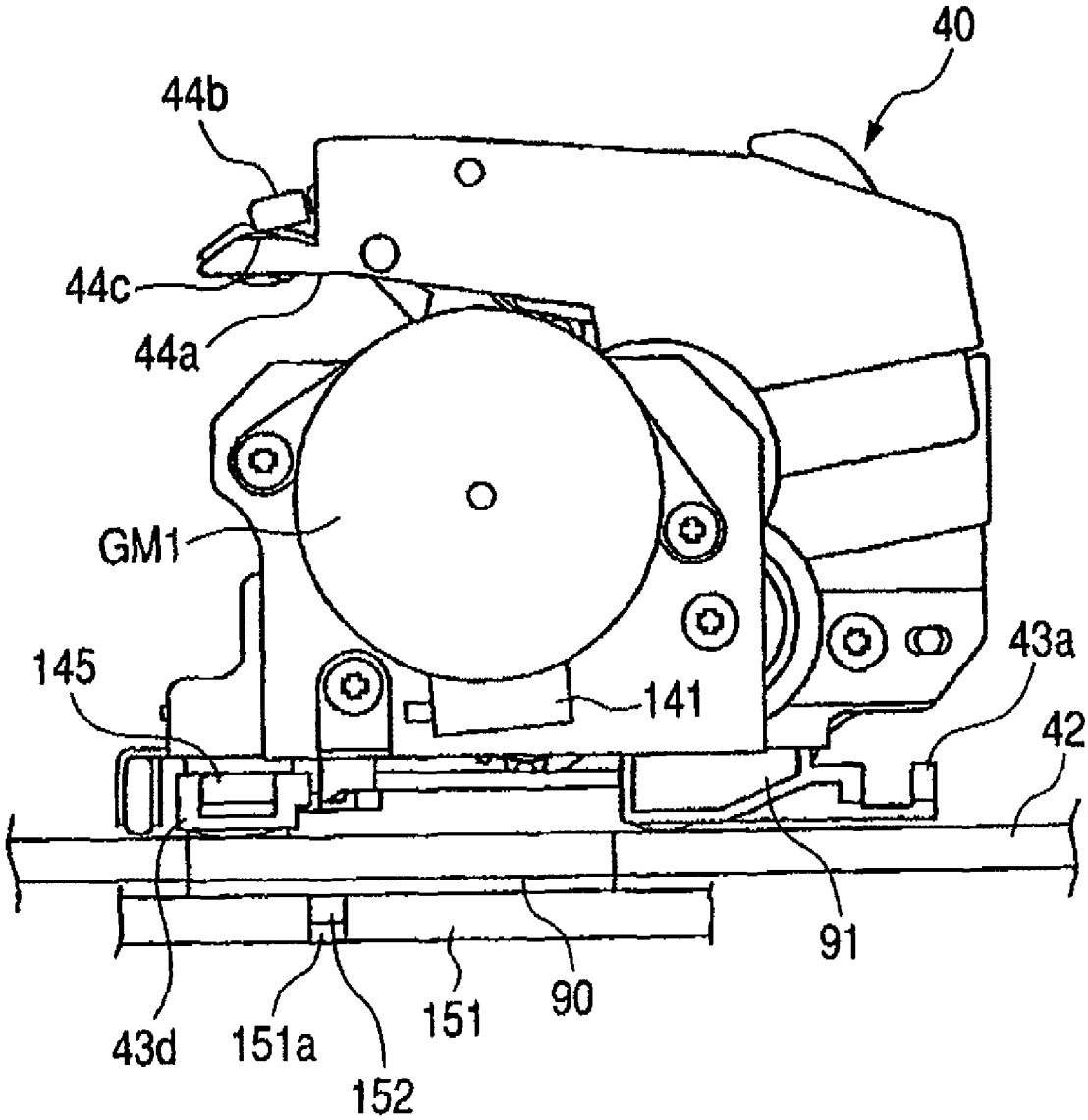
FIG. 4 is a side view illustrating the appearance of a gripper unit provided in a gripper staple section of the sheet processing apparatus.
Figure 5A:
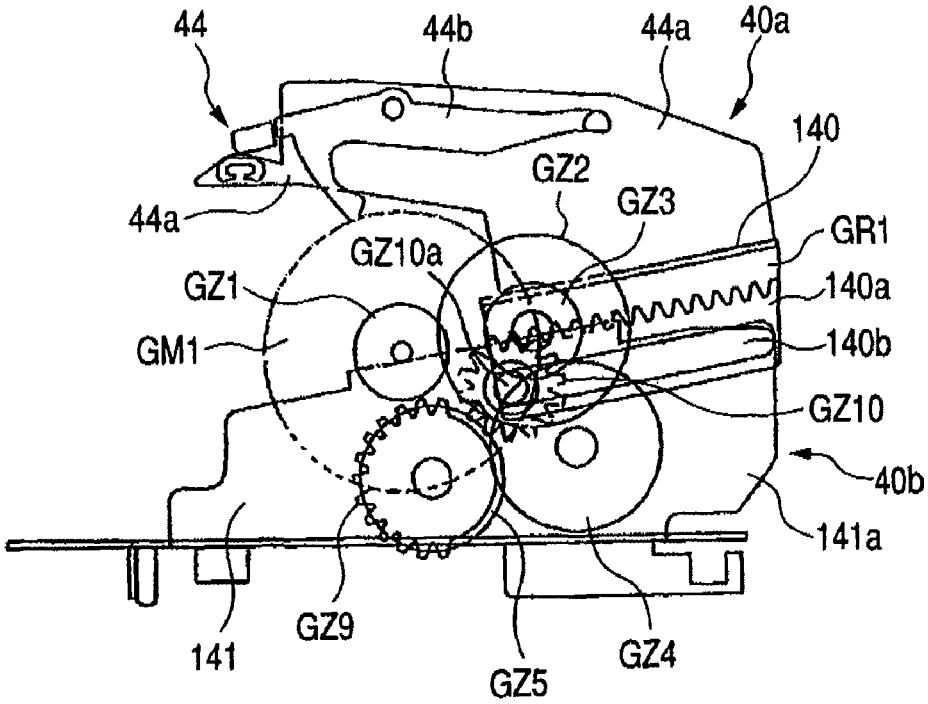
FIGS. 5A and 5B are first diagrams illustrating the configuration of the gripper unit.
Figure 5B:
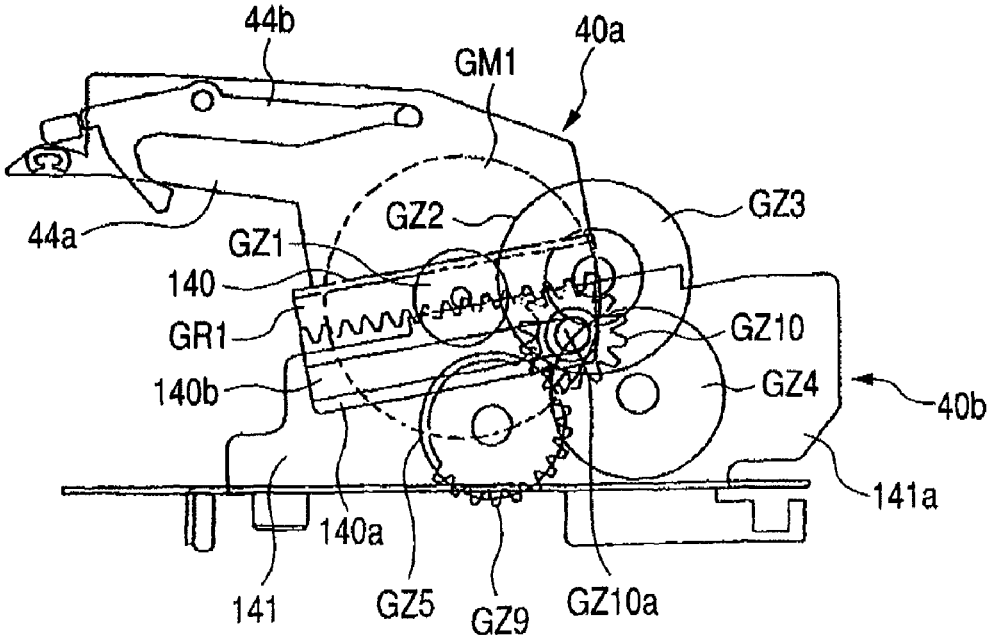

FIG. 4 is a side view illustrating the appearance of the gripper unit 40. As illustrated in FIGS. 5A and 5B, the gripper unit 40 includes a first gripper unit 40*a* with paired grip arms 44 gripping a sheet bundle aligned on the processing tray 14. Furthermore, a second gripper unit 40*b* provided in the gripper unit 40 includes a driving mechanism which supports the first gripper unit 40*a* so that the first gripper unit 40*a* can slide parallel to the sheet discharging direction and which allows the grip arm pair 44 to grip the sheet bundle.

Figure 6A:
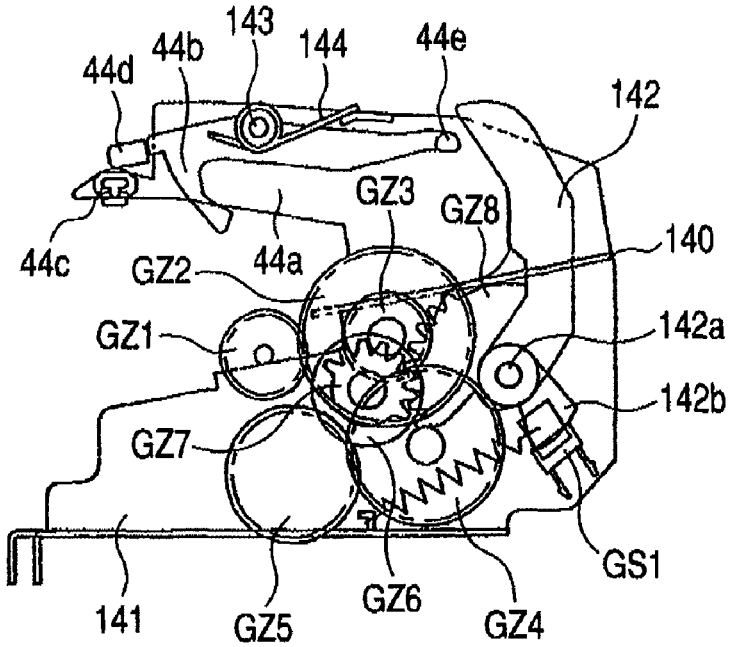
FIGS. 6A and 6B are second diagrams illustrating the configuration of the gripper unit.
Figure 6B:
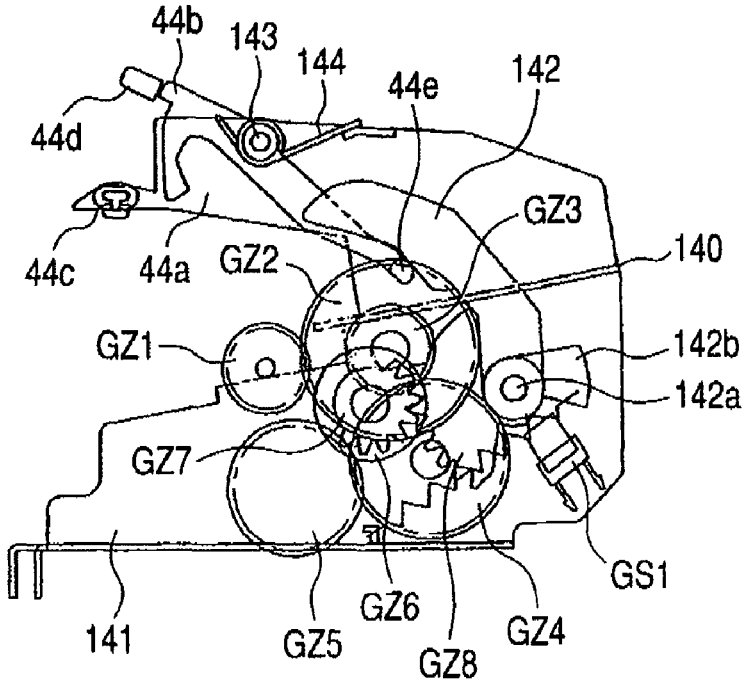

The first gripper unit 40*a* includes the grip arm pair 44 having a grip arm pair 44 with a fixed grip arm 44*a* that supports the bottom surface of sheet bundle and a movable grip arm 44*b* provided above and opposite the fixed grip arm 44*a* to press the top surface of the sheet bundle. As illustrated in FIGS. 6A and 6B, the fixed grip arm 44*a* is mounted on a planar first base member 140. The movable grip arm 44*b* is attached to the fixed grip arm 44*a* so as to be pivotally movable, in the vertical direction, around a pivotal shaft 143 serving as a support point.

The pivotal shaft 143 includes a coil spring 144 serving as biasing means. The opposite ends of the coil spring 144 extend to the fixed grip arm 44*a* and the movable grip arm 44*b*, respectively. The coil spring 144 operates to bias the grip section 44*d* of the movable grip arm 44*b* so that the grip section 44*d* is compressed against the grip section 44*c* of the fixed grip arm 44*a*. The grip arm pair 44 is thus closed to apply a grip force required to grip sheets.

The second grip unit 40*b* includes a driving lever 142 illustrated in FIGS. 6A and 6B and which biases the movable grip arm 44*b* in a direction in which the movable grip arm 44*b* moves away from the fixed grip arm 44*a*, and a grip motor GM1 illustrated in FIGS. 4 and 5A and 5B and which drives the driving lever 142. Driving from the grip motor GM1 is transmitted to the driving lever 142 via a plurality of gears GZ1 to GZ8 illustrated in FIGS. 6A and 6B. That is, a driving mechanism allowing the grip arm pair 44 to grip a sheet bundle includes the driving lever 142, the grip motor GM1, and the plurality of gears GZ1 to GZ8. Furthermore, the position of the driving lever 142 is detected by a lever detection sensor GS1 by sensing the position of a detection flag 142*b* provided integrally with the driving lever 142. In the exemplary embodiment, when the grip arm pair 44 is closed as illustrated in FIG. 6A, the lever detection sensor GS1 is on. When the grip arm pair 44 is open as illustrated in FIG. 6B, the lever detection sensor GS1 is off.

Now, the operation of a driving mechanism allowing a sheet bundle to be gripped will be described. Normally, the grip arm pair 44 is closed as illustrated in FIG. 6A under the effect of the coil spring 144. To open the grip arm pair 44, the grip motor GM1 is rotated forward (counterclockwise as viewed in FIG. 4). The driving from the grip motor GM1 is transmitted via the plurality of gears GZ1 to GZ7 to the final gear GZ8 formed integrally with the driving lever 142. Thus, the driving lever 142 moves pivotally around a shaft 142*a* serving as a support point, toward the movable grip arm 44*b*. Thereafter, the tip of the driving lever 142 brings into abutting contact with an abutting contact section 44*e* formed opposite the grip section 44*d* of the movable grip arm 44*b* with respect to the shaft 143. The abutting contact section 44*e* thus moves downward.

As a result, the grip section 44*d* of the movable grip arm 44*b* rotates upward around the rotating shaft 143 serving as a support point. Then, as illustrated in FIG. 6B, the grip section 44*d* of the movable grip arm 44*b* is separated from the grip section 44*c* of the fixed grip arm 44*a*. Thus, the grip arm pair 44 shifts from the closed state to the open state. Thereafter, if a predetermined time elapses from the end of the detection, by the lever detection sensor GS1, of the detection flag 142*b* provided integrally with the driving lever 142, the grip motor GM1 is stopped. Thus, the grip arm pair 44 is kept open.

To allow the grip arm pair 44 to be closed, the grip motor GM1 is rotationally driven backward (clockwise). The backward rotational driving of the grip motor GM1 allows the tip portion of the driving lever 142 to move pivotally around a shaft 142*a* serving as a support point, in a direction in which the tip portion leaves the abutting contact section 44*e* of the movable grip arm 44*b*. Correspondingly, the effect of the coil spring 144 allows the abutting contact portion 44*e* of the movable grip arm 44*b* to rotate counterclockwise around the rotating shaft 143 serving as a support point. Thus, the tip portion of the driving lever 142 separates from the abutting contact portion 44*e* of the movable grip arm 44*b*. Then, the grip arm pair 44 is closed as illustrated in FIG. 6A. The bias force of the coil spring 144 allows a grip force required to grip sheets to be applied to the movable grip arm 44*b*. The grip motor GM1 is stopped when the detection flag 142*b* is detected by the lever detection sensor GS1.

Here, in the exemplary embodiment, as illustrated in FIG. 3, three (a plurality of) grip arm pairs 44, three (a plurality of) coil springs 144 each applying a grip force, and three (a plurality of) driving levers 142 each cancelling the grip force are provided in the width direction. The three grip arm pairs 44 are driven by one grip motor GM1. As illustrated in FIG. 3, the three grip arm pairs 44 are attached to a base member 140 illustrated in FIGS. 6A and 6B, at predetermined intervals. Each of the three driving levers 142 is attached to a shaft 142*a* attached across the sides of a second base member 141. Thus, the gripper unit 40 allows the three driving levers 142 to rotate simultaneously, and allows one side of the sheets to be gripped at three positions for conveyance.

The first gripper unit 40*a* is supported by the second gripper unit 40*b* so as to be slidable parallel to the sheet discharging direction as described above. Now, a moving mechanism for the first gripper unit 40*a* will be described. The first base member 140 to which the grip arm pair 44 illustrated in FIGS. 5A and 5B is attached includes a downward folded widthwise end. A moving rack GR1 for moving the first gripper unit 40*a* is attached to the corner of the folded portion 140*a* of the first base member 140. Furthermore, a slot 140*b* serving as a slide hole is formed in the folded portion 140*a* of the first base member 140.

The slot 140*b* is penetrated by a rotating shaft GZ10*a* of a pinion gear GZ10 that meshes with the moving rack GR1. The rotating shaft GZ10*a* is rotatably supported by a side plate 141*a* of the second gripper unit 40*b*. Thus, when the pinion gear GZ10, provided in the second gripper unit 40*b*, is rotated, the first gripper unit 40*a* moves via the moving rack GR1. That is, rotation of the pinion gear GZ10 allows the first gripper unit 40*a* to move to an initial position illustrated in FIG. 5A and to a discharge position illustrated in FIG. 5B and in which the sheets are discharged.

The moving rack GR1 is configured to lower toward the downstream side in sheet discharging direction. This configuration allows the upper part of the grip arm pair 44 to be positioned to project from the top surface of the processing tray 14 if the first gripper unit 40*a* is in the initial position. The configuration also allows the upper part of the grip arm pair 44 to be located below the top surface of the processing tray 14 if the first gripper unit 40*a* is in the discharge position.

Thus, the driving mechanism for moving the first gripper unit 40*a* includes the grip motor GM1, the plurality of gripper gears GZ1 to GZ5, a gripper gear GZ9 provided on the rotating shaft of the fifth gripper gear GZ5, and a pinion gear GZ10. In the exemplary embodiment, as described above, the grip motor GM1 is used as a driving source for opening and closing the grip arm pair 40 and a driving source for moving the first gripper unit 40*a*. Since the grip motor GM1 is used as a common driving source, the seventh gripper gear GZ7 for opening and closing the grip arm pair 44 as illustrated in FIGS. 6A and 6B, adopts a fail gear with an area to which the driving of the grip motor GM1 is transmitted and an area to which the driving of the grip motor GM1 is not transmitted. Furthermore, the ninth gripper gear GZ9 for moving the first gripper unit 40*a* adopts a similar fail gear.

Here, when the seventh gripper gear GZ7 using the fail gear uses a part of the outer peripheral teeth portion to open and close the grip arm pair 44, the fail gear portion of the ninth gripper gear GZ9 is positioned opposite the succeeding gear portion. This prevents the driving from being transmitted to the succeeding gear portion. On the other hand, when the ninth gripper gear GZ9 using the fail gear uses a part of the outer peripheral teeth portion to move the first gripper unit 40*a*, the fail gear portion of the seventh gripper gear GZ7 is positioned opposite the succeeding gear portion. This prevents the driving from being transmitted to the succeeding gear portion. When the driving mechanism is formed using the fail gear, the operation of opening and closing the grip arm pair 44 can be easily switched to movement of the first gripper unit 40*a*, or vice versa.

Then, a configuration for moving the gripper unit 40 in the sheet discharging direction will be described. As illustrated in FIG. 4, the gripper unit 40 includes the second base member 141 with two sliding pins 145 provided on the bottom surface thereof so as to extend in the width direction. The sliding pins 145 are engaged with a groove portion of the fourth guide rail 43*d*, allowing the gripper unit 40 to move in the width direction. In this coupling mechanism, the sliding pins 145 are engaged with the groove portion of the fourth guide rail 43*d* to couple the gripper unit 40 to the fourth guide rail 43*d*. The fourth guide rail 43*d* and the coupling mechanism will be described below in further detail.

Figure 7:
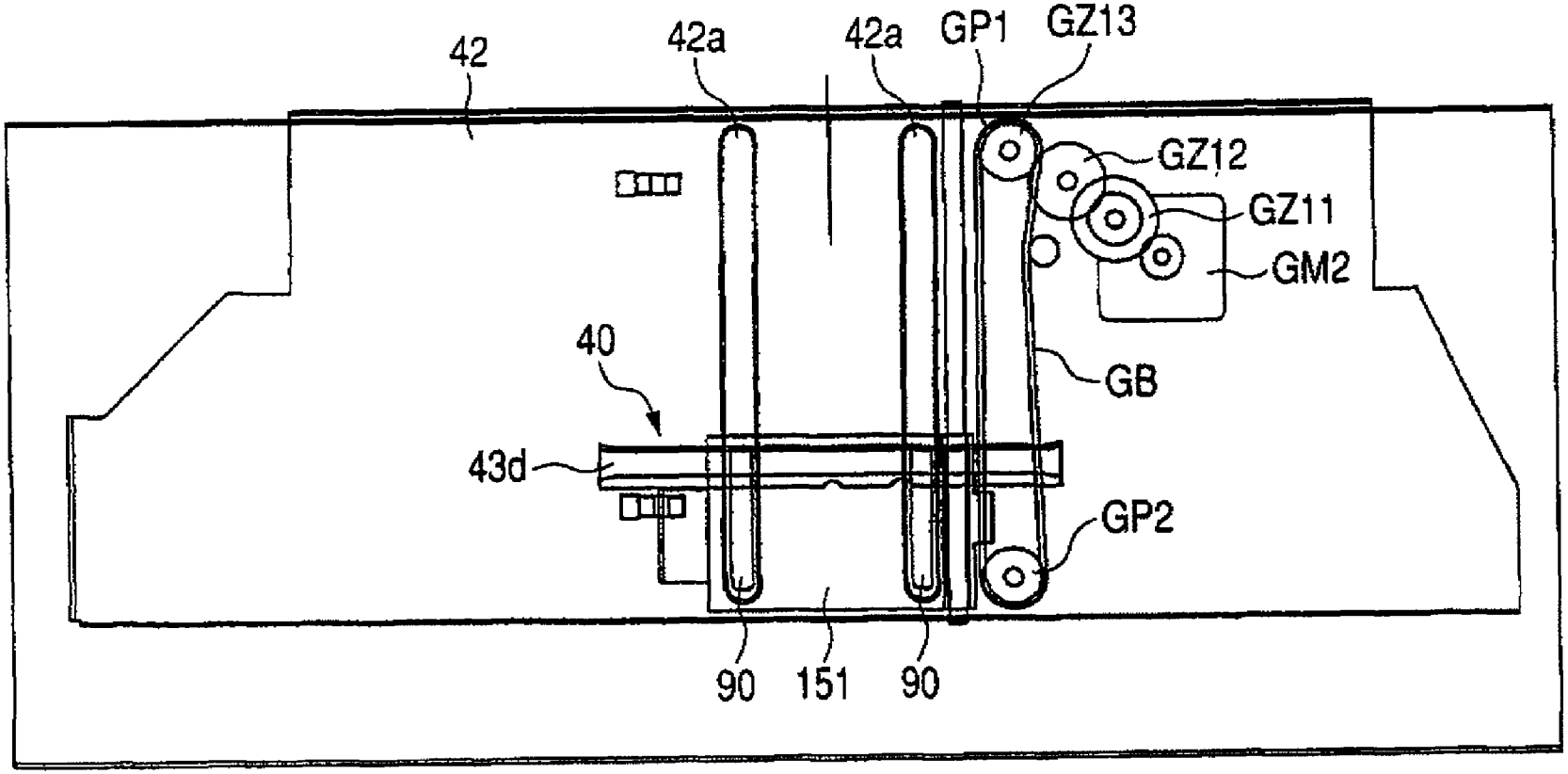
FIG. 7 is a diagram illustrating a configuration for moving the gripper unit in a sheet discharging direction.

Engagement portions 90 are formed on the bottom surface of the fourth guide rail 43*d* at predetermined positions so as to project downward; the engagement portions 90 engage with long grooves 42*a* formed in a base 42 illustrated in FIG. 7 and supporting the gripper unit 40 and the staple unit 41, the long groove 42*a* extending in the sheet discharging direction. Two long grooves 42*a* are formed parallel to each other with a predetermined distance therebetween. Two engagement portions 90 are formed at the respective positions on the bottom surface of the fourth guide rail 43*d* coupled to the gripper unit 40, so as to extend parallel to each other in the sheet discharging direction (see FIG. 7).

The two long grooves 42*a* have a low profile that avoids obstructing movement of the staple unit 41, so as to form a groove-like guide rail along which the gripper unit 40 is guided. The long grooves 42*a*, serving as a groove-like guide rail, forms a first guide section guiding the gripper unit 40. Moreover, a boss 152 is provided on the bottom surface of each of the engagement portions 90 so as to couple to a plate-like member 151 located on the bottom surface of the base 42. The boss 152 is fitted into a fit-in hole 151*a* in the plate-like member 151 to integrate the fourth guide rail 43*d* with the plate-like member 151.

Here, the plate-like member 151 is coupled to an endless belt GB provided along the long groove 42*a* through which the gripper unit 40 is moved. Thus, driving the endless belt GB allows the gripper unit 40 to move along the long grooves 42*a* integrally with the plate-like member 151 and the fourth guide rail 43*d*, a support member supporting the gripper unit 40. Then, thus moving the fourth guide rail 43*d* allows the gripper unit 40 to sit in the discharge position where the sheets are discharged onto the second stack tray 51 and in the coupling position where the gripper unit 40 is coupled to the staple unit 41.

The endless belt GB is driven by a gripper motor GM2 illustrated in FIG. 7, paired pulleys GP1 and GP2 around which the endless belt GB is passed, and a plurality of gears GZ11 to GZ13 transmitting driving from the gripper motor GM2 to the endless belt GB. That is, in the exemplary embodiment, a second moving mechanism (driving mechanism) is configured as described below which moves the gripper unit 40 in the sheet discharging direction crossing the side of the sheets to be stapled. That is, the second moving mechanism includes a gripper motor GM2, the endless belt GB, the paired pulleys GP1 and GP2, and the plurality of gears GZ11 to GZ13.

Now, the staple unit 41, a stapling apparatus, will be described below. The staple unit 41 includes a staple head and an anvil block both built into the unit. A needle-like staple is folded into a U shape, and the folded staple is then pressed in a sheet bundle. The tip of the staple is folded by the anvil block to staple the sheet bundle. The exemplary embodiment adopts a general staple unit configured as follows. A head block is attached to one of an upper lever member and a lower lever member with the base end of each member borne by a shaft of the other member, and the anvil block is attached to the other member. The upper and lower members are reciprocated from a separate position to a pressure contact position by a driving cam member. Furthermore, in the exemplary embodiment, the staple unit 41 can move to a position where the sheets are stapled at one widthwise end, a position where the sheets are stapled at the other end opposite to the one widthwise end, and a position where one side of the sheets are stapled at two positions.

Figure 8:
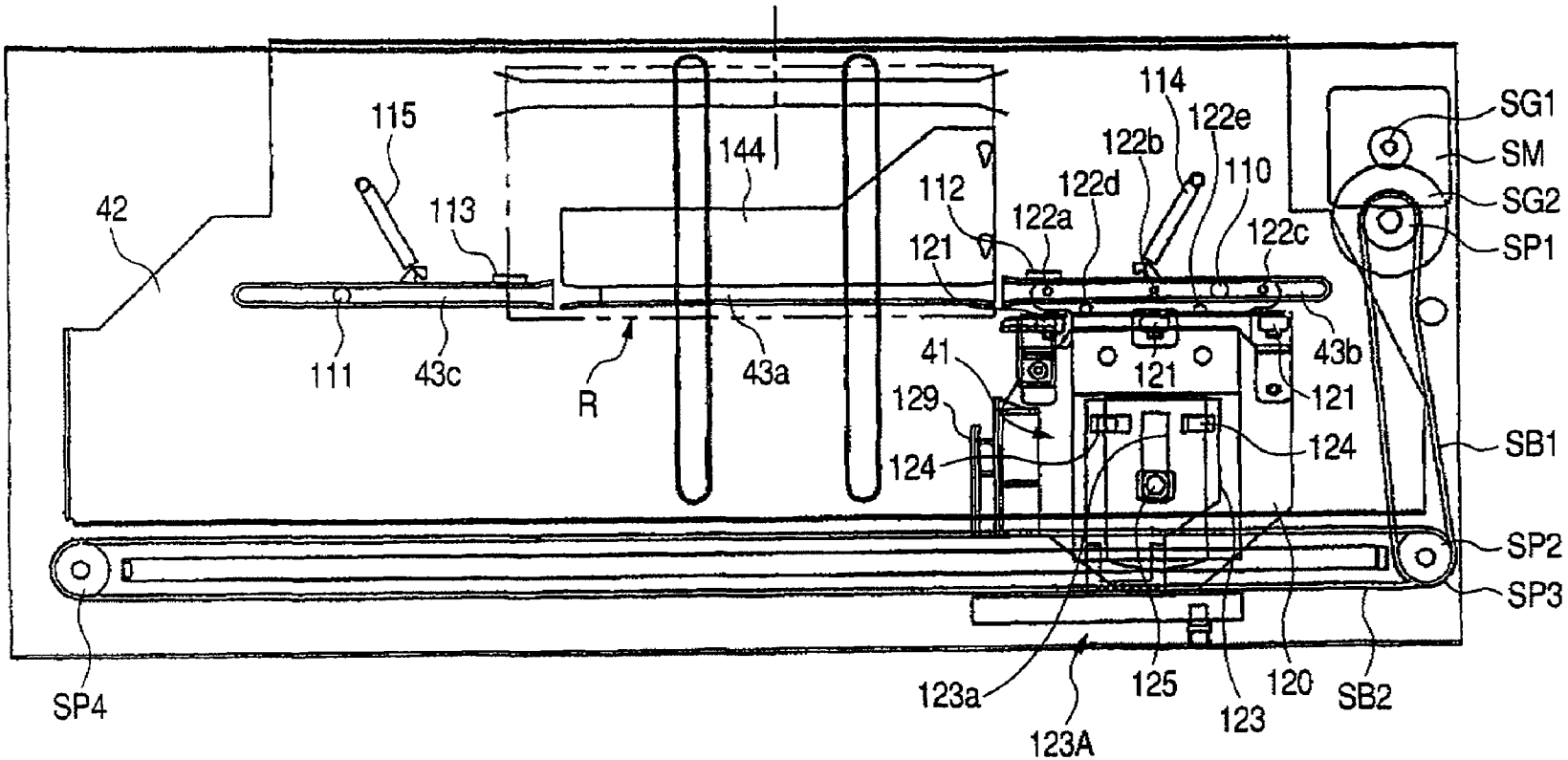
FIG. 8 is a diagram illustrating a configuration for moving a staple unit provided in the gripper staple section of the sheet processing apparatus.

FIG. 8 is a diagram illustrating a configuration for moving the staple unit 41. The staple unit 41 is mounted on the base member 120. The base member 120 includes three skids 121 required to assist in moving the staple unit 41. The base member 120 also includes three bosses 122*a* to 122*c* required that engage a guide rail section R described below so as to move the staple unit 41 along the guide rail section R. The base member 120 also includes two bosses 122*d* and 122*e* arranged in line and upstream of the three bosses 122*a* to 122*c* in the sheet discharging direction and used to couple the gripper unit 40 and the staple unit 41 together for movement. The base member 120 also includes a coupling member 123 provided on the bottom surface thereof and which is coupled to an endless belt SB2 in order to move the staple unit 41. The coupling member 123 includes two skids 124 and a slot 123*a* which are required to assist in moving the staple unit 41. A boss 125 provided on the bottom surface of the base member 120 penetrates the slot 123*a* in the coupling member 123. The slot 123*a* extends parallel to the sheet discharging direction. The boss 125 is configured to be movable parallel to the sheet discharging direction along the slot 123*a*.

A driving mechanism that is a moving mechanism for moving the staple unit 41 includes a staple motor SM, a gear SG1 attached to a driving shaft of the staple motor SM, and a gear SG2 that meshes with the gear SG1. The driving mechanism also includes a pulley SP1 attached to a rotating shaft of the gear SG2, and a pulley SP2 paired with the pulley SP1 and around which a timing belt SB1 is passed. The driving mechanism also includes pulley SP3 provided on a rotating shaft of the pulley SP2 and around which an endless belt SB2 is passed, and a pulley SP4 paired with the pulley SP3 and around which the endless belt SB2 is passed. The motor SM, the timing belt SB1, the endless belt SB2, the base member 120, the gears SG1 and SG2, and the pulleys SP1 to SP4 form a first moving mechanism for moving the staple unit 41 along the side of the sheets to be stapled.

A guide rail section R allowing the staple unit 41 to move in the width direction is provided on the base 42, on which the gripper unit 40 moves. The guide rail section R is formed to be longer than the width of the maximum sheet. Thus, one side of the sheets can be stapled at a predetermined position by moving the staple unit 41 along the guide rail section R.

In the driving mechanism configured as described above, driving from the staple motor SM is transmitted to the endless belt SB2 via the timing belt SB1 to rotate the endless belt SB2. Rotation of the endless belt SB2 moves the coupling member 123. Then, the thus moved coupling member 123 allows the base member 120 and the staple unit 41 attached to the base member 120 to move, via the boss 125, along the guide rail section R.

In the exemplary embodiment, as described above, the exemplary embodiment is configured to be able to carry out the end stapling process in which the sheets are stapled at one of the opposite ends thereof at a corresponding stapling position (first or second stapling position) and the two-position stapling process in which the sheets are stapled in a substantially central portion thereof at two positions with respect to one side of the sheets in the width direction. The configuration of the guide rail section R varies between the end stapling process and the two-position stapling process.

Specifically, in the end stapling process, the guide rail section R is divided into three pieces, a first guide rail 43*a* to a third guide rail 43*c*, in the width direction. A first guide rail 43*a* included in the three guide rails 43*a* to 43*c* and positioned in the center of the three guide rails is fixed to the rear of bottom of the gripper unit 40 (the upstream side of the gripper unit 40 in the sheet discharging direction) as illustrated in FIG. 4. Furthermore, the second and third guide rails 43*b* and 43*c* positioned on the respective opposite sides of the first guide rail 43*a* are fixed to the base 42.

Here, when located in a predetermined retract position where the gripper unit 40 avoids obstructing movement of the staple unit 41, the first guide rail 43*a* lies in line with the second and third guide rails 43*b* and 43*c* (in the same straight line). When the first to third guide rails 43*a* to 43*c* line up, the three bosses 122*a* to 122*c* arranged in line on the staple unit 41 come into engagement with the first to third guide rails 43*a* to 43*c*, respectively. The staple unit 41 then moves in the width direction. Furthermore, as described above, the bosses (projections) 122*a* to 122*c* allowing the staple unit 41 to move along the guide rail section R are attached to the front bottom portion (the upstream bottom portion in the sheet discharging direction) of the base member 120 supporting the staple unit 41.

According to this configuration, when the staple unit 41 moves across the gripper unit 40 in order to staple an end of the sheets, the gripper unit 40 has moved to the retract position to avoid obstructing movement of the staple unit 41. This precludes the movement of the staple unit 41 in the width direction from being prevented. Thus, the staple unit 41 can be moved to the corner of the sheets to be stapled before a sheet is conveyed to the processing tray 14. Furthermore, the gripper unit 40 is located so as to grip a substantially central portion of the sheets in the width direction. When pre-moved to the corner of the sheets, the staple unit 41 is prevented from obstructing movement of the gripper unit 40.

Here, the second and third guide rails 43*b* and 43*c*, positioned on the respective opposite sides of the first guide rail 43*a*, are mounted on the base 42 so as to be able to be swung by swinging shafts 110 and 111 positioned on the respective opposite sides of the first guide rail 43*a*. Thus, if the staple unit 41 is used to carry out an end stapling process, the staple unit 41 can be tilted by about 45° integrally with the second and third guide rails 43*b* and 43*c* to staple an end (corner) of the sheets. The swinging shafts 110 and 111 are arranged downstream of the boss 125 in the sheet discharging direction provided on the bottom surface of the base member 120.

Now, the configuration in which the staple unit is inclined by about 45° will be described. The configuration for stapling the end of the sheets located closer to the second guide rail 43*b* and the configuration for stapling the end of the sheets located closer to the third guide rail 43*c* are the same and laterally symmetric. Thus, for convenience, here, only the configuration for the second guide rail 43*b* will be described.

As illustrated in FIG. 8, a tension spring 114 is provided between the base 42 and the inside portion of the swinging shaft 110 of the second guide rail 43*b*. The operation of the tension spring 114 serves to always bias the second guide rail 43*b* clockwise in FIG. 8. The term "inside" as used herein refers to the area between a comparison target and the widthwise center of the sheets conveyed to the sheet processing apparatus C (the width direction is the same as the direction crossing the sheet discharging direction). A regulation member 112 regulating the second guide rail 43*b* always biased by the tension spring 114 is provided on the base 42 inside the swinging shaft 110. The regulation member 112 allows the second guide rail 43*b* to be held at a first position crossing the sheet discharging direction, thus forming a guide rail section R that is continuous with the first guide rail 43*a* attached to the gripper unit 40. On the third guide rail 43*c* side, a tension spring 115 and a regulation member 113 function similarly to the tension spring 114 and the regulation member 112.

Here, when the endless belt SB2 is driven to move the staple unit 41 outward along the second guide rail 43*b*, the boss 122*c* of the base member 120 engaged with the second guide rail 43*b* brings into abutting contact with the end of the second guide rail 43*b*. The expression "move outward" as used herein refers to movement away from the widthwise center of the sheets conveyed to the sheet processing apparatus C (the width direction is the same as the direction crossing the sheet discharging direction). This allows the widthwise movement of the staple unit 41 to be regulated. In this state, further driving the endless belt SB2 allows the coupling member 123 secured to the endless belt SB2 to move in association with the driving of the endless belt SB2. The boss 125 of the base member 120 is correspondingly pulled outward.

Figure 9:
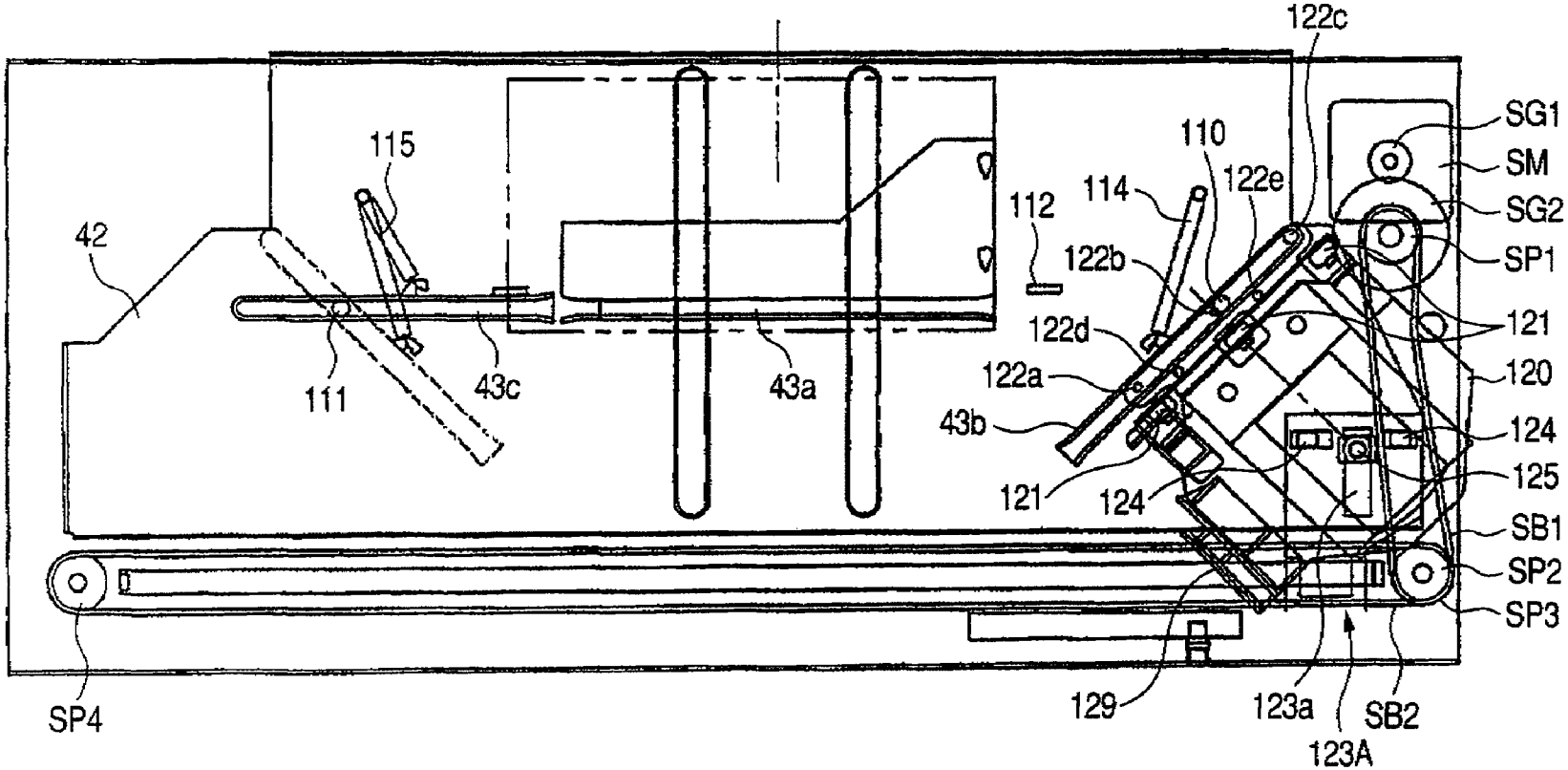
FIG. 9 is a diagram illustrating how the staple unit is tilted.

At this time, the widthwise movement of the base member 120 is regulated by the end of the second guide rail 43*b*. As described above, the swinging shaft 110 is located downstream of the boss 125 in the sheet discharging direction. Thus, when the boss 125 is pulled, the base member 120 and the staple unit 41 rotate integrally around the swinging shaft 110 serving as a support point, with the boss 125, an engagement piece, moved in the sheet discharging direction along the slot 123*a* in the coupling member 123, as shown in FIG. 9. Moreover, at this time, the base member 120 and staple unit 41 rotate the second guide rail 43*b* counterclockwise around the swinging shaft 110 serving as a support point, against the force of the tension spring 114. Thus, the second guide rail 43*b* moves to the second position where the second guide rail 43*b* is inclined integrally with the staple unit 41 with respect to one side of the sheets. The staple unit 41 is correspondingly tilted, resulting in successful oblique stapling of a corner of one side of the sheets.

Thus, in the exemplary embodiment, the coupling member 123 and the boss 125 provided on the base member 120 form a tilting mechanism 123A for moving the staple unit 41 to a position where the staple unit 41 is inclined with respect to an end of one side of the sheets. The tilting mechanism 123A allows the staple unit 41 having brought into abutting contact with the end of the second guide rail 43*b* to move to the second position integrally with the second guide rail 43*b*.

On the other hand, the gripper unit 40 is positioned in the widthwise central portion of the base 42. Thus, in two-position stapling, the staple unit 41 overlaps the gripper unit 40 in the width direction. Thus, the gripper unit 40 serves as an obstacle, preventing the staple unit 41 from carrying out two-position stapling without taking any special measures. Thus, in the exemplary embodiment, in the two-position stapling, the gripper unit 40 is moved to the position where the gripper unit 40 avoids obstructing the two-position stapling carried out by the staple unit 41. Specifically, when the staple unit 41 moves to the position where the staple unit 41 carries out the two-position stapling, the gripper unit is moved in the width direction integrally with the staple unit 41.

Here, to be moved in the width direction integrally with the staple unit 41, first, the gripper unit 40 is moved to the unit coupling position P2 illustrated in FIG. 3 described above when the two-position stapling is to be carried out. When the gripper unit 40 moves in this manner, the fourth guide rail 43*d* attached to the bottom surface of the gripper unit 40 illustrated in FIG. 4 moves upstream of the second and third guide rails 43*b* and 43*c* in the sheet discharging direction as illustrated in FIG. 7. This position corresponds to the two bosses 122*d* and 122*e* arranged in line upstream of the three bosses 122*a* to 122*c* in the sheet discharging direction.

Thus, if the staple unit 41 and the gripper unit 40 are coupled together, the staple unit 41 can be moved in the width direction together with the gripper unit 40, with the two bosses 122*d* and 122*e* engaged with the fourth guide rail 43*d*. That is, moving the gripper unit 40 to the unit coupling position P2 allows the second to fourth guide rails 43*b* to 43*d* to form the guide rail section R, a guide section. Then, when the staple unit 41 coupled to the gripper unit 40 moves, the gripper unit 40 coupled to the staple unit 41 moves in the same direction as that in which the staple unit 41 moves, while supported by the fourth guide rail 43*d*.

In this configuration, in the two-position stapling, if the staple unit 41 moves from the second guide rail to the third guide rail, first, the staple unit 41 moves with the bosses 122*a* to 122*c* engaged with the second guide rail 43*b*. Then, when the boss 122*a* of the staple unit 41 is removed from the second guide rail 43*b*, the boss 122*d* of the staple unit 41 comes into engagement with the fourth guide rail 43*d* moved to the position illustrated in FIG. 7, in conjunction with movement of the gripper unit 40.

As a result, the staple unit 41 is held first by the second guide rail 43*b* and then by the fourth guide rail 43*d* in conjunction with the movement of the staple unit 41. Furthermore, when the boss 122*d* of the staple unit 41 is removed from the fourth guide rail 43*d*, the boss 122*a* of the staple unit 41 then comes into engagement with the third guide rail 43*c*. When coupled to the staple unit 41 for movement, the gripper unit 40 is removed from the fourth guide rail 43*d*. However, the gripper unit 40 is fixedly coupled to the staple unit 41 so as not to move in the width direction or the sheet discharging direction with respect to the staple unit 41. Thus, the gripper unit 40 moves in conjunction with movement of the staple unit 41 without any problem.

FIGS. 10A and 10B and FIGS. 11A and 11B are diagrams illustrating a unit coupling mechanism forming a coupling section that couples the gripper unit 40 to the staple unit 41. As illustrated in FIGS. 10A and 10B and FIGS. 11A and 11B, the unit coupling mechanism includes a first unit coupling mechanism 60*a* that is a first coupling mechanism 60*a* coupling the staple unit 41 and the gripper unit 40 together in the sheet discharging direction. The unit coupling mechanism includes a second unit coupling mechanism 60*b* that is a second coupling mechanism coupling the staple unit 41 and the gripper unit 40 together in the width direction.

The first unit coupling mechanism 60*a* includes an engagement member 129 attached to the base member 120 of the staple unit 41 as illustrated in FIG. 8, and a coupling arm member 132 supported on a side portion of the second base member 141 of the gripper unit 40. The first unit coupling mechanism 60*a* includes an actuation member 131 provided on the shaft 142*a* of the driving arm 142, which opens and closes the grip arm pair 40. The coupling arm member 132 includes an engagement pin 132*a* formed at one end thereof and which engages with a groove portion 129*a* of the engagement member 129, and an actuation pin 132*b* formed at the other end and which is fitted into a slit 131*a* in the actuation member 131.

Figure 10A:
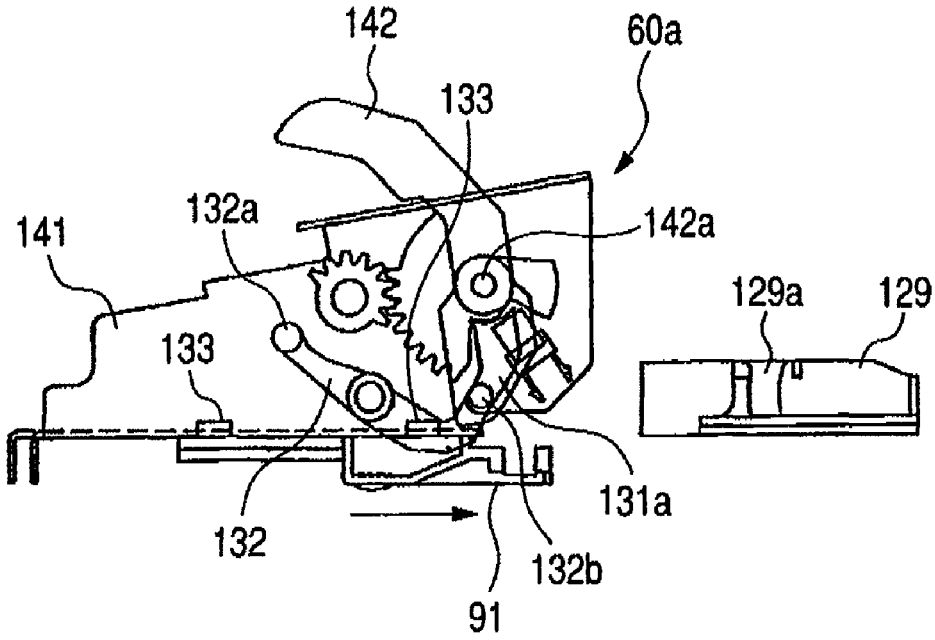
FIGS. 10A and 10B are diagrams illustrating a unit coupling mechanism coupling the gripper unit and the staple unit together.
Figure 10B:
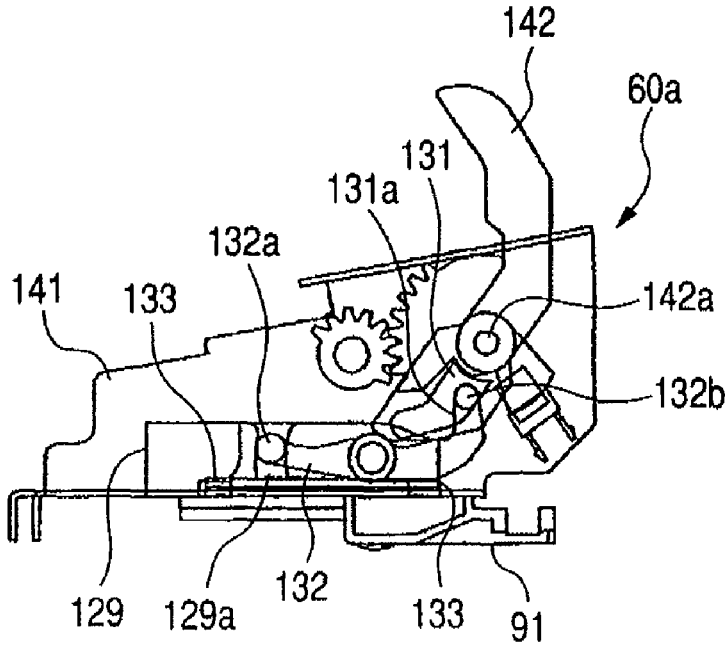

Here, when moved to the unit coupling position P2, the gripper unit 40 moves in the direction of an arrow illustrated in FIG. 10A with the engagement pin 132*a* of the coupling arm member 132 located in an upper, retract position. In this case, the staple unit 41 has moved to and is standing by in a position where the staple unit 41 can be coupled to the gripper unit 40. When the gripper unit 40 reaches a coupling position where the fourth guide rail 43*d* is located upstream of the second and third guide rails 43*b* and 43*c* in the sheet discharging direction, the gripper motor GM2 is driven to pivotally move the actuation member 131 clockwise. Thus, the actuation pin 132*b* fitted in the slit 131*a* in the actuation member 131 is lifted upward to rotate the coupling arm member 132 counterclockwise around the shaft thereof serving as a support point. Then, as illustrated in FIG. 10B, the engagement pin 132*a* of the coupling arm member 132 comes into engagement with the groove portion 129*a* of the engagement member 129 of the staple unit 41 moved to and standing by in the position where the engagement pin 132*a* can be coupled to the gripper unit 40. Thus, the gripper unit 40 and the staple unit 41 can be coupled together in the moving direction of the gripper unit 40.

Figure 11B:
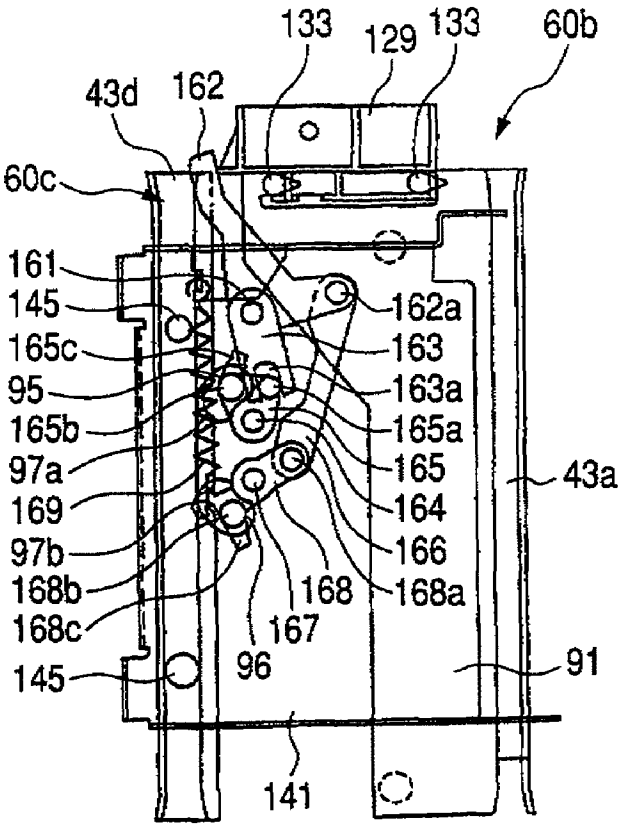
FIGS. 11A and 11B are diagrams illustrating a coupling mechanism coupling the unit coupling mechanism and the gripper unit and a fourth guide rail together.

Furthermore, the second unit coupling mechanism 60*b* includes a coupling member 91 attached to the bottom surface of the second base member 141, and two projections 133 formed at the respective widthwise opposite ends of the coupling member 91. The projections 133 of the coupling member 91 are configured to enter groove portions (not illustrated in the drawings) formed in the bottom surface of the engagement member 129 by moving the gripper unit 40 to the unit coupling position P2 as illustrated in FIG. 10B and FIG. 11B. Thus, the staple unit 41 and the gripper unit 40 are coupled together in the width direction, that is, in the moving direction of the staple unit 41, and move integrally in the width direction. In the exemplary embodiment, the coupling member 91 and the first guide rail 43*a* are integrally formed of resin.

Here, to be coupled to the staple unit 41 so that the coupled gripper unit 40 and staple unit 41 can move in the width direction, the gripper unit 40 needs to be disconnected from the fourth guide rail 43*d*. This is because the fourth guide rail 43*d* is used as a rail along which the staple unit 41 moves. Furthermore, the driving coupling between the gripper unit 40 and the gripper motor GM2 needs to be canceled. Thus, in the exemplary embodiment, as described above, the fourth guide rail 43*d* is integrated with the plate-like member 151, which is coupled to the endless belt GB driven by the gripper motor GM2. Furthermore, the fourth guide rail 43*d* and the gripper unit 40 are configured so as to be coupled together and to be decoupled from each other. Thus, a single mechanism can be used both for coupling and decoupling of the gripper unit 40 and the fourth guide rail 43*d* and for driving coupling and decoupling of the gripper unit 40 and the gripper motor GM2.

Now, a coupling mechanism 60*c* that couples the gripper unit 40 and the fourth guide rail 43*d* together will be described with reference to FIGS. 11A and 11B. The coupling mechanism 60*c* includes a swinging lever 162 attached to a first swinging shaft 161 provided on the top surface of the second base member 141, and a swinging member 163 attached to the first swinging shaft 161 to swing in conjunction with a swinging operation of the swinging lever 162. The coupling mechanism 60*c* also includes a first actuation member 165 with a pin 165*a* formed thereon; the pin 165*a* is attached to a second swinging shaft 164 provided on the top surface of the second base member 141 and engages with a slit 163*a* in the swinging member 163. The coupling mechanism 60*c* also includes a link member 166 with a hole formed at one end thereof and into which a pin 162*a* formed on the swinging lever 162 is fitted. The coupling mechanism 60*c* further includes a second actuation member 168 with a pin 168*a* formed thereon; the pin 168*a* is attached to a third swinging shaft 167 and is fitted into a hole formed at the other end of the link member 166.

The first actuation member 165 includes a cylindrical first actuation pin 165*b* extended from the top surface to bottom surface of the second base member 141, and a first actuation piece 165*c* formed at the tip of extension side of the first actuation pin 165*b*. Swinging of the first actuation member 165 allows the first actuation pin 165*b* to be fitted into a bent portion 97*a* formed on a side surface of a protruding portion of the fourth guide rail 43*d* which forms a groove. Thus, the protruding portion of the fourth guide rail 43*d* is sandwiched between the first actuation pin 165*b* and the sliding pins 145 provided on the bottom surface of the second base member 141 and engaged with the grooves in the fourth guide rail 43*d*. Furthermore, swinging of the first actuation member 165 allows the first actuation piece 165*c* to move to the bottom surface of the protruding portion of the fourth guide rail 43*d*. Thus, the protruding portion of the fourth guide rail 43*d* is sandwiched between the first actuation piece 165*c* and the bottom surface of the second base member 141.

The second actuation member 168 includes a cylindrical second actuation pin 168*b* extended from the top surface to bottom surface of the second base member 141, and a second actuation piece 168*c* formed at the tip of extension side of the second actuation pin 168*b*. Swinging of the second actuation member 168 allows the second actuation pin 168*b* to be fitted into a bent portion 97*b* formed on a side surface of a protruding portion forming a groove in the fourth guide rail 43*d*. The second actuation piece 168*c* moves to the bottom surface of the protruding portion of the fourth guide rail 43*d*. Thus, the protruding portion of the fourth guide rail 43*d* is sandwiched between the second actuation pin 168*b* and the sliding pins 145. Furthermore, the protruding portion of the fourth guide rail 43*d* is sandwiched between the second actuation piece 168*c* and the bottom surface of the base member 141.

A tension spring 169 is provided between the second actuation member 168 and the second base member 141 to rotationally bias the second actuation member 168 clockwise around a third rotating shaft 167 serving as a support point. Furthermore, openings 95 and 96 are formed in the second base member 141 so that the first and second actuation pins 165*b* and 168*b* can move through the openings 95 and 96, respectively.

Figure 11A:
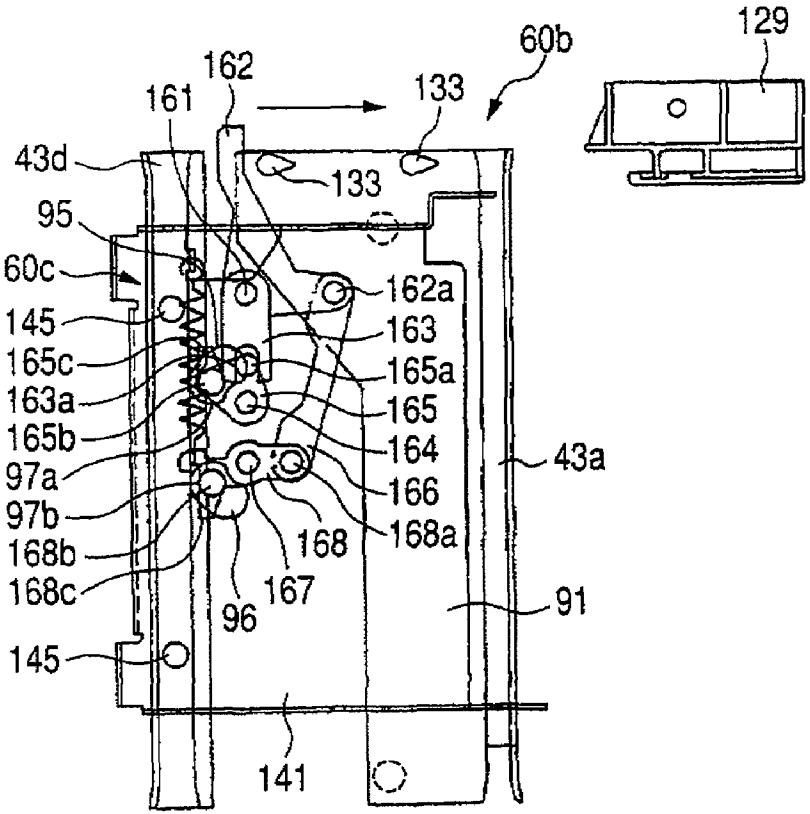

In this configuration, before the gripper unit 40 moves to and arrives at the coupling position, the effect of the tension spring 169 allows the second actuation member 168 to rotate clockwise as illustrated in FIG. 11A. Thus, the second actuation pin 168*b* is fitted into the bent portion 97*b* of the side surface of the protruding portion of the fourth guide rail 43*d*. The second swinging piece 168*c* moves to below the bottom surface of the protruding portion of the fourth guide rail 43*d*. Furthermore, the clockwise rotation of the second actuation member 168 is transmitted to the swinging lever 162 via the link member 166, and the swinging lever 162 is rotated clockwise. Moreover, the rotation of the swinging lever 162 rotates the swinging member 163 clockwise, and the swinging member 163 rotates the first actuation member 165 counterclockwise. Thus, the first actuation pin 165*b* is fitted into the bent portion 97*a* of the side surface of the protruding portion of the fourth guide rail. The first swinging piece 168*c* moves to below the bottom surface of the protruding portion.

On the other hand, when the gripper unit 40 reaches the coupling position, the tip of the swinging lever 162 brings into abutting contact with the engagement member 129 of the staple unit 41. The swinging lever 162 then rotates counterclockwise against the effect of the tension spring 169. This rotating operation rotates the swinging member 163 counterclockwise, and the first actuation member 165 rotates clockwise. Thus, as illustrated in FIG. 10B, the first actuation pin 165*b* separates from the bent portion 97*a* of the protruding portion of the rail 43*d*. The first actuation piece 165*c* moves to a position where the first actuation piece 165*c* is retracted from the bottom surface of the protruding portion of the rail 43*d*. Furthermore, when the swinging lever 162 rotates counterclockwise, the rotation is transmitted to the second actuation member 168 via the link member 166, and the second actuation member 168 rotates clockwise. Thus, the second actuation pin 168*b* separates from the bent portion 97*b* of the protruding portion of the rail 43*d*. The second actuation piece 168*c* moves to a position where the second actuation piece 168*c* is retracted from the bottom surface of the protruding portion of the rail 43*d*.

Thus, in the exemplary embodiment, before the gripper unit 40 moves to and arrives at the coupling position, the protruding portion of the fourth guide rail 43*d* is laterally sandwiched between the sliding pins 145 of the second base member 141 and the first and second actuation pins 165*b* and 168*b*. Furthermore, the protruding portion of the fourth guide rail 43*d* is vertically sandwiched between the bottom surface of the second base member 141 and both the first and second actuation pieces 165*c* and 168*c*. Thus, the gripper unit 40 is coupled to the fourth guide rail 43*d*.

On the other hand, when the gripper unit 40 is moved to the position where the gripper unit 40 is coupled to the staple unit 41, the swinging lever 162 brings into abutting contact with the engagement member 129. Thus, the swinging lever 162 swings. The swinging of the swinging lever 162 allows the first and second actuation pins 165*b* and 168*b* to separate from the side portion of the protruding portion of the fourth guide rail 43*d*. Furthermore, the first and second actuation pieces 165*c* and 168*c* are moved to a position where the first and second actuation pieces 165*c* and 168*c* are retracted from the bottom surface of the protruding portion of the fourth guide rail 43*d*. Thus, the coupling between the gripper unit 40 and the fourth guide rail 43*d* is cancelled. This cancellation operation enables the gripper unit 40 to move in the width direction.

Figure 22:
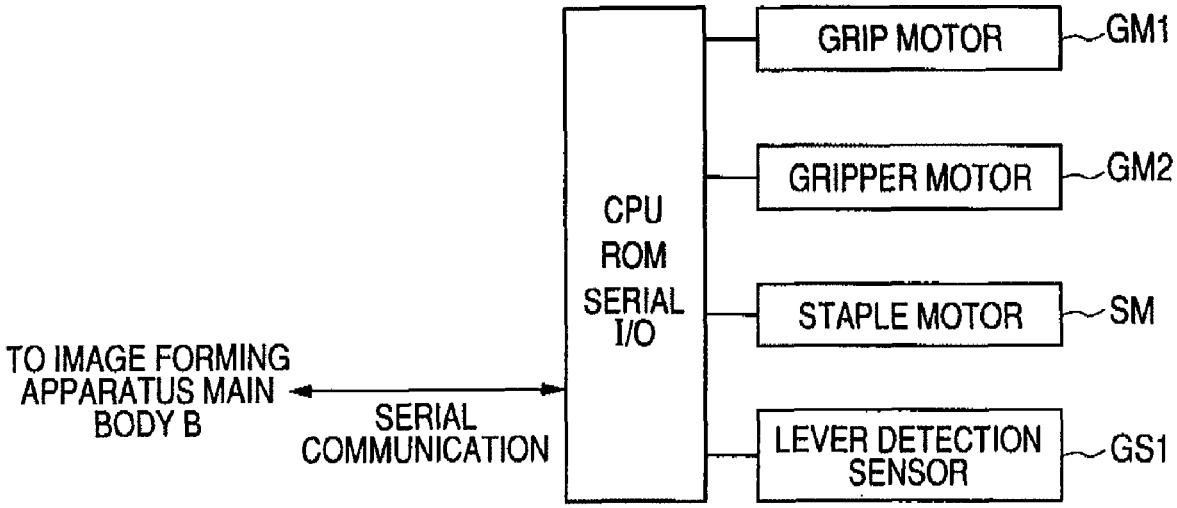
FIG. 22 is a control block diagram of the sheet processing apparatus.

FIG. 22 is a control block diagram of the sheet processing apparatus C. A CPU that is a control section connects to the grip motor GM1, the gripper motor GM2, and the staple motor SM. The CPU is also connected to the lever detection sensor GS1 so as to receive detection signals from the lever detection sensor GS1. Furthermore, the CPU internally includes a ROM. Programs and the like corresponding to control procedures illustrated in FIG. 12 to FIG. 20 described below are stored in the ROM. The CPU reads the programs to control the motors. Furthermore, the CPU includes a serial interface section (I/O) to transmit and receive control data to and from the image forming apparatus main body B. Moreover, the CPU controls the relevant sections based on control data transmitted by (the control section of) the image forming apparatus main body B via the serial interface section (I/O). In the exemplary embodiment, the CPU is provided in the sheet processing apparatus C but may be provided in the image forming apparatus main body B.

Figure 12:
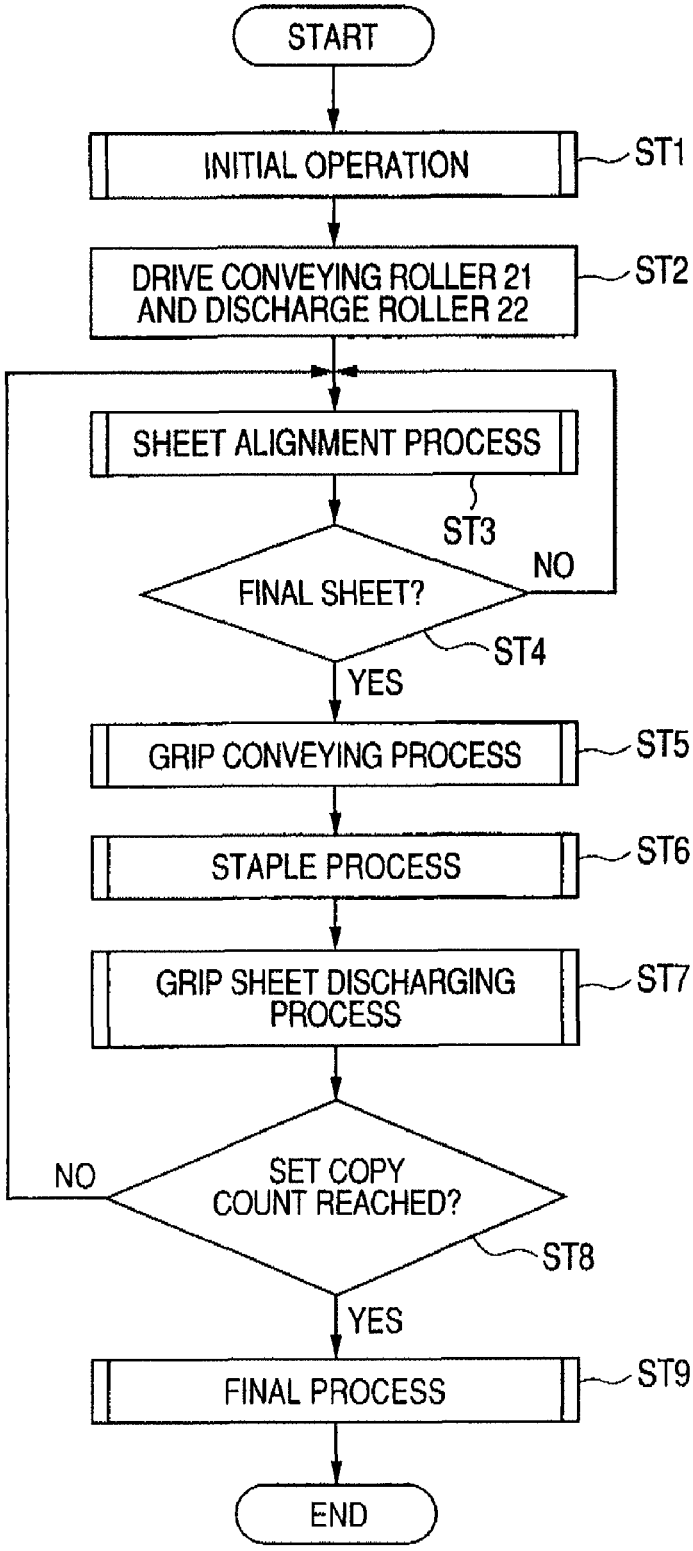
FIG. 12 is a main-operation flowchart illustrating the main flow of a staple operation of the sheet processing apparatus.
Figure 13:
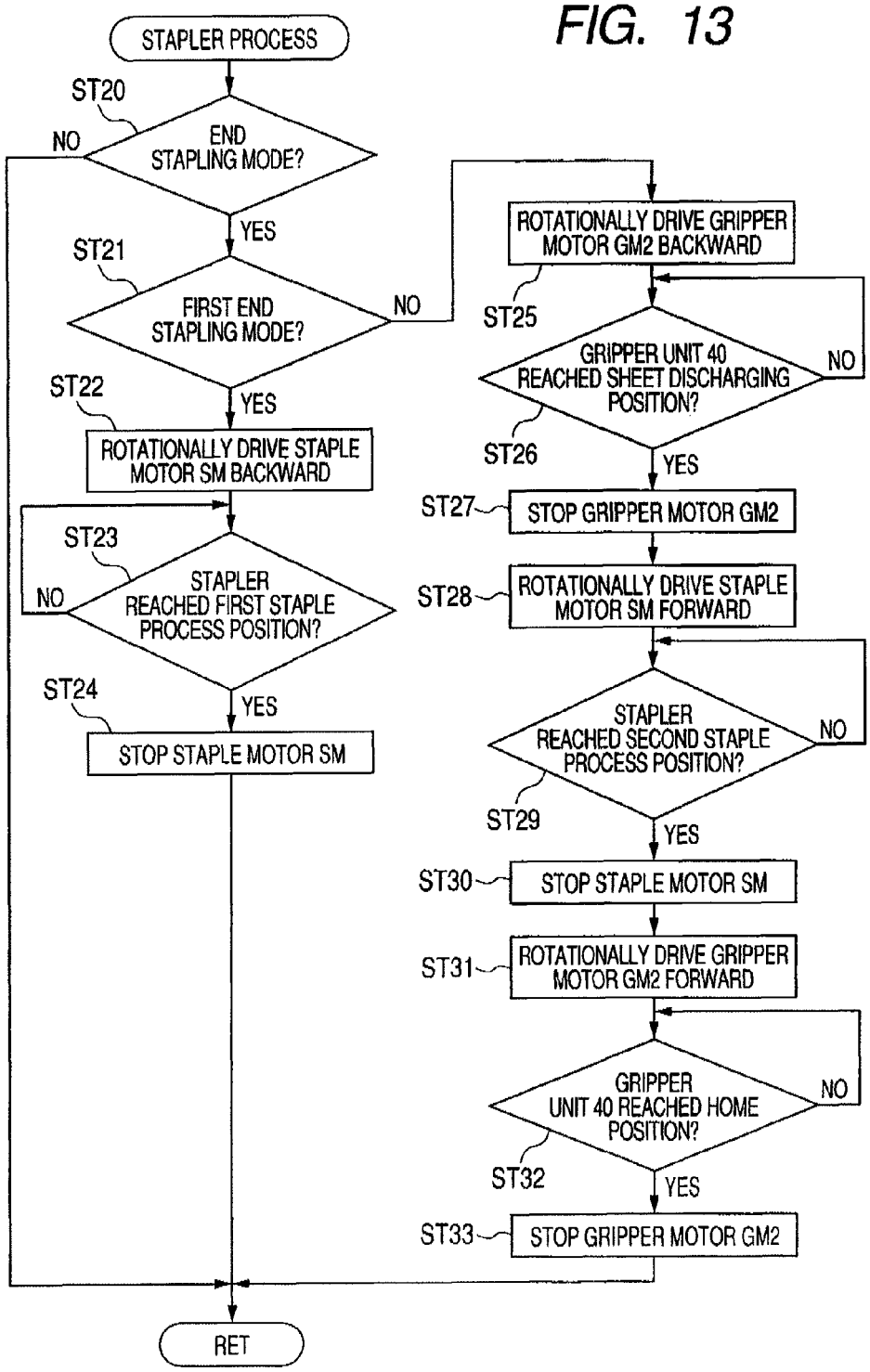
FIG. 13 is an operation flowchart illustrating a staple preprocess of the sheet processing apparatus.
Figure 14:
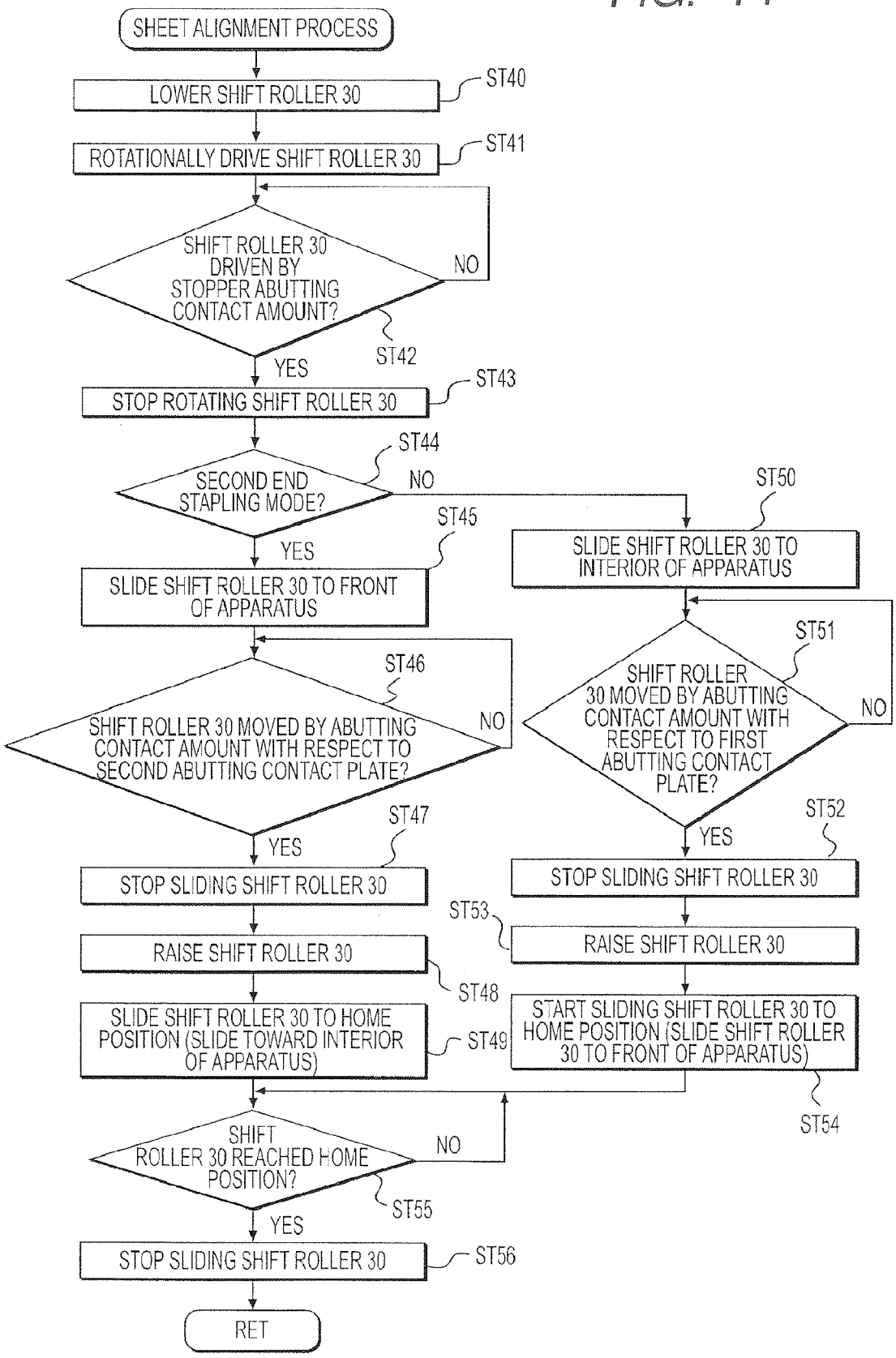
FIG. 14 is an operation flowchart illustrating a sheet alignment process of the sheet processing apparatus.
Figure 15:
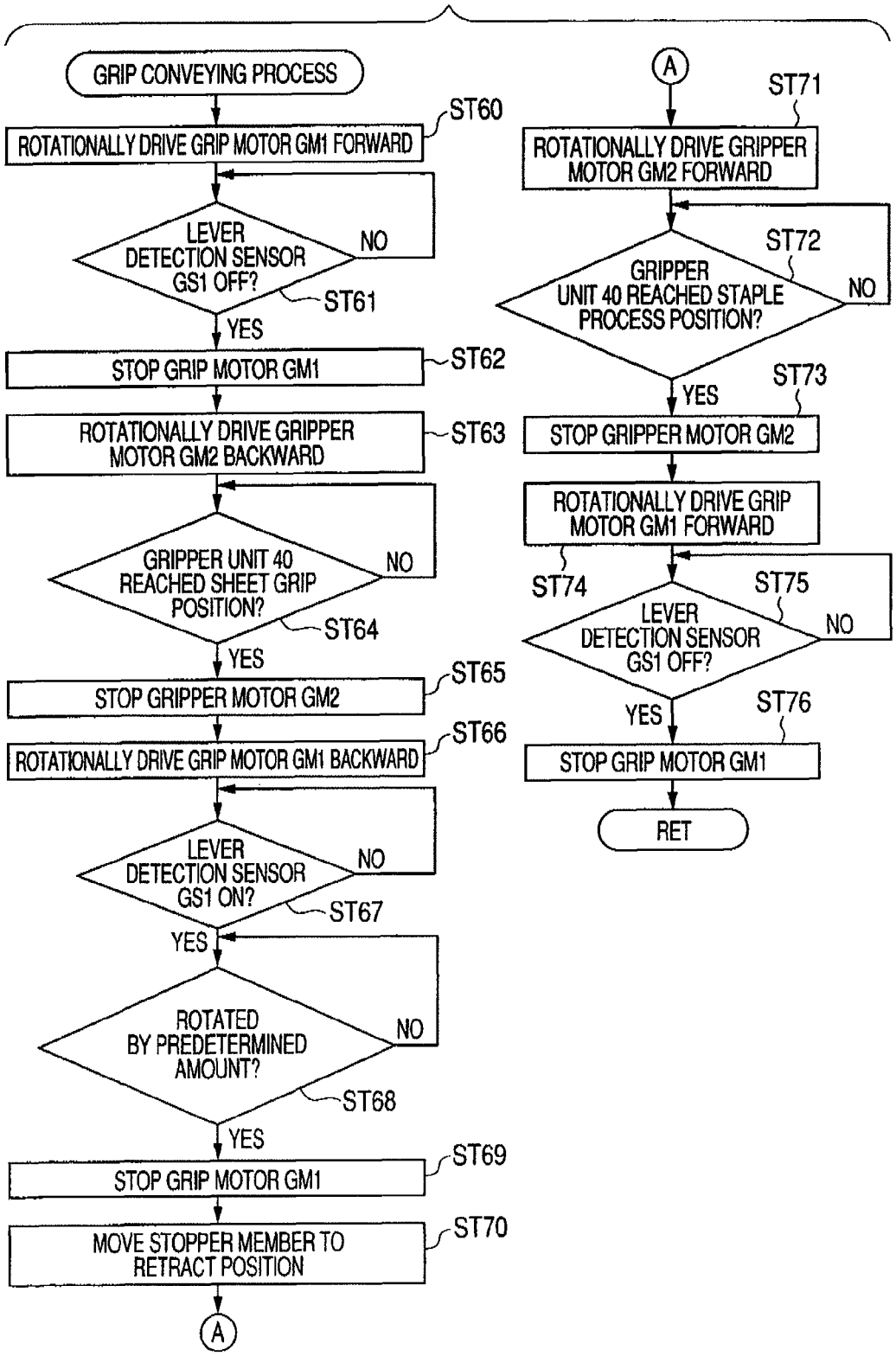
FIG. 15 is an operation flowchart illustrating a grip conveying process of the sheet processing apparatus.
Figure 16:
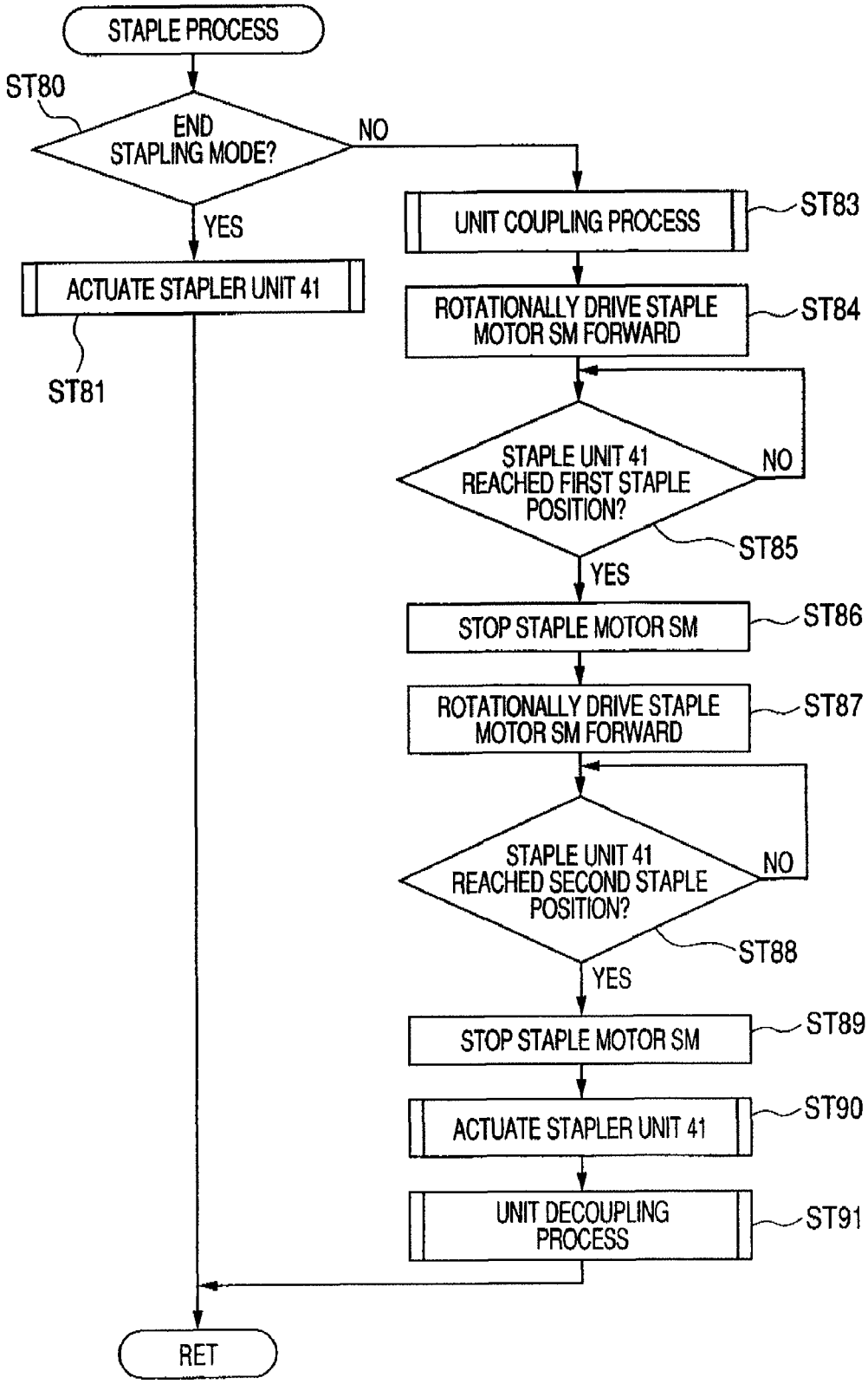
FIG. 16 is an operation flowchart illustrating a staple process of the sheet processing apparatus.

Now, a staple operation of the sheet processing apparatus C will be described. The staple operation is controlled by a control section G provided in the sheet processing apparatus C or the image forming apparatus main body B shown in FIG. 1 to selectively carry out the two-position stapling mode (plural-position stapling mode) or the end stapling mode. FIG. 12 is a main-operation flowchart illustrating the main flow of the staple operation of the sheet processing apparatus C. The staple operation will be described with reference to the operation flowchart.

Upon receiving information such as the sheet size and the stapling mode from the image forming apparatus main body B, the sheet processing apparatus C first performs an initial operation for carrying out a staple operation (ST1). During the initial operation, the sheet processing apparatus C detects, for example, the presence or absence of a retained sheet, the positions of the staple unit 41 and the gripper unit 40, and the conditions of the shift roller 30 and the stopper member 31. If there is any remaining sheet, the sheet processing apparatus C transmits error information to the image forming apparatus main body B. Furthermore, if the staple unit 41, the gripper unit 40, the shift roller 30, the stopper member 31, or the like is not in the home position or the initial position, the sheet processing apparatus C controls the corresponding member such that the member moves to the home position or the initial position.

Furthermore, during the initial operation, the sheet processing apparatus C carries out a staple preprocess of premoving the staple unit 41 to a predetermined stapling position according to the stapling mode. Now, the staple preprocess will be described with reference to the operation flowchart in FIG. 13. To carry out the staple preprocess, the sheet processing apparatus C determines whether or not the stapling mode is the end stapling mode based on the stapling mode information from the image forming apparatus main body B (ST20). If the stapling mode is the end stapling mode (Y in ST20), the sheet processing apparatus C determines whether or not the end stapling mode is the first end stapling mode in which the corner of sheets positioned in the back of the sheet processing apparatus C is stapled (ST21). Here, if the stapling mode is the first end stapling mode (Y in ST21), the staple motor SM is rotationally driven backward (ST22).

Thus, the staple unit 41 in the home position SHP moves in the direction of a dotted arrow (b) in FIG. 3 (toward the back of the apparatus). Then, when the staple unit 41 reaches a first staple position where the staple unit 41 is inclined by about 45° (Y in ST23), the staple motor SM is stopped (ST24). Thus, before a sheet is carried out onto the processing tray 14, the staple unit 41 moves to and is placed in the first staple position.

If the stapling mode is the second end stapling mode in which the corner of the sheets positioned in the front of the sheet processing apparatus is stapled (N in ST21), the gripper motor GM2 is rotationally driven backward (ST25) to move the gripper unit 40 in the direction of a dotted arrow (d) in FIG. 3. Then, when the gripper unit 40 reaches a rail coupling position (sheet discharging position) P3 (Y in ST26), the gripper motor GM2 is stopped (ST27). Then, a guide rail section R is formed in which the first guide rail 43*a* is continuous with the second and third guide rails 43*b* and 43*c*. Hence, the staple unit 41 can move in the width direction.

After the gripper unit 40 reaches the rail coupling position P3, the staple motor SM is rotationally driven forward (ST28) to move the staple unit 41 in the direction of a solid arrow (a) in FIG. 3 (toward the front of the apparatus) from the home position SHP. Then, when the staple unit 41 reaches a second staple position in the front of the apparatus where the staple unit 41 is inclined by about 45° (Y in ST29), the staple motor SM is stopped (ST30). Thus, before a sheet is carried out onto the processing tray 14, the staple unit 41 moves to and is placed in the second staple position. When the staple unit 41 is thus placed in the staple position, the gripper motor GM2 is rotationally driven forward (ST31) to return the gripper unit 40 to the home position. When the gripper unit 40 reaches the home position (Y in ST32), the gripper motor GM2 is stopped (ST33).

As described above, before a sheet reaches the processing tray 14, the staple unit 41 is moved to the staple position corresponding to the stapling mode. Then, when a sheet bundle is conveyed to the processing position, the stapling process is immediately carried out. Thus, even a miniaturized apparatus enables an easy reduction in staple processing time.

Then, when the above-described initial operation is completed, the conveying roller 21 and the discharge roller 22 are driven (ST2) to discharge the sheets onto the processing tray 14 as illustrated in FIG. 12. Thereafter, a sheet alignment process is carried out (ST3). Now, the sheet alignment process will be described with reference to the operation flowchart in FIG. 14. The sheet alignment operation is performed as follows. When sheets are discharged onto the processing tray 14, the shift roller 30 is lowered (ST40) and brought into contact with the sheet top surface. Then, the shift roller 30 is rotationally driven (ST41) to convey the sheets toward the stopper member 31. Thereafter, the shift roller 30 is driven by a predetermined stopper abutting contact amount. When the shift roller 30 is driven by the stopper abutting contact amount (Y in ST42), the sheets bring into abutting contact with the stopper member 31 moved to an alignment position. When the sheets bring into abutting contact with the stopper member 31, the rotation of the shift roller 30 is stopped (ST43). Thus, the trailing end positions of the sheets are aligned. The stopper abutting contact amount corresponds to the amount by which the sheets are conveyed by the shift roller 30 and which is preset to bring the trailing ends of the discharged sheets into abutting contact with the stopper member 31. In actuality, driving pulses for a feed motor (not illustrated in the drawings) that rotates the shift roller 30 are counted to measure the driving amount.

Then, when the sheet trailing ends bring into abutting contact with the stopper member 31 to stop the sheets, the shift roller 30 moves in the slide direction selected according to the stapling mode. That is, if the stapling mode is the second end stapling mode (Y in ST44), the shift roller 30 is slid toward the front of the sheet processing apparatus (ST45). At this time, since the outer peripheral surface of the shift roller 30 is formed of a high-friction member, the sheet contacted with the shift roller 30 is also slid toward the second abutting contact plate 32*b*, located in the front of the apparatus, as the shift roller 30 moves. Then, when the shift roller 30 is moved by an abutting contact amount at which the sheet ends bring into abutting contact with the second abutting contact plate 32*b* (Y in ST46), the slide operation of the shift roller 30 is stopped (ST47). Thereafter, the shift roller 30 is raised (ST48). The shift roller 30 is slid toward the back of the apparatus and to the home position (ST49). When the shift roller 30 reaches the home position at the widthwise center of the sheets (Y in ST55), the sliding of the shift roller 30 is stopped (ST56).

On the other hand, if the stapling mode is not the second end stapling mode, that is, the first end stapling mode or the two-position stapling mode (N in ST44), the shift roller 30 is slid toward the back of the apparatus (ST50). Then, when the shift roller 30 is moved by an abutting contact amount at which the sheet ends bring into abutting contact with the first abutting contact plate 32*a* (Y in ST51), the sliding of the shift roller 30 is stopped (ST52). Thereafter, the shift roller 30 is raised (ST53) and slid toward the front of the apparatus to the home position (ST54). Then, when the shift roller 30 reaches the home position (Y in ST55), the sliding of the shift roller 30 is stopped (ST56).

Then, when the above-described sheet alignment process is completed, the sheet processing apparatus determines, based on sheet information from the image forming apparatus main body B, whether or not the aligned sheet is the final sheet of the sheet bundle as shown in FIG. 12 (ST4). If the aligned sheet is not the final (N in ST4), the apparatus waits for the succeeding sheet to be discharged onto the processing tray. Thereafter, the sheet alignment process is repeated for each sheet until the final sheet of the sheet bundle is aligned.

When all the sheets are aligned, that is, when the aligned sheet is the final sheet of the sheet bundle (Y in ST4), a grip conveying process is carried out in which the gripper unit 40 conveys the sheet bundle to the staple process position (ST5). Now, the grip conveying process will be described with reference to the operation flowchart in FIG. 15. To carry out the grip conveying process, first, the grip motor GM1 is rotationally driven forward (ST60). Then, when the lever detection sensor GS1 is turned off, that is, when the lever detection sensor GS1 detects passage of the detection flag 142*b* (Y in ST61), the grip motor GM is driven by a predetermined amount and then stopped (ST62). Thus, as shown in FIG. 6B described above, the movable grip arm 44*b* leaves the fixed grip arm 44*a*. The grip arm pair 44 is thus open.

In this state, the gripper motor GM2 is rotationally driven backward (ST63) to move the gripper unit 40 to a sheet grip position where the gripper unit 40 grips the sheet bundle aligned by the sheet alignment process. Then, when the gripper unit 40 reaches the sheet grip position (Y in ST64), the gripper motor GM2 is stopped (ST65). Then, the grip motor GM1 is rotationally driven backward (ST66). When the lever detection sensor GS1 is turned on, that is, when the lever detection sensor GS1 detects the detection flag 142*b* (Y in ST67), the driving lever 142 is rotated by a predetermined amount. When the driving lever 142 is rotated by a predetermined amount (Y in ST68), the grip motor GM1 is stopped (ST69). Thus, under the effect of the coil spring 144, the movable grip arm 44*b* is biased toward the fixed grip arm 44*a* to allow the gripper unit 40 to grip the sheet bundle as shown in FIG. 6A. Hence, the sheet bundle is gripped.

Then, the stopper member 31 is moved to the retract position (ST70). This enables the gripper unit 40 gripping the sheet bundle to move toward the staple process position GHP. Then, the gripper motor GM2 is rotationally driven forward (ST71) to move the gripper unit 40 gripping the sheet bundle to move in the direction of a solid arrow (c) shown in FIG. 3. Thereafter, when the gripper unit 40 gripping the sheet bundle reaches the staple process position GHP (Y in ST72), the gripper motor GM2 is stopped (ST73) to place the gripper unit 40 in the staple process position GHP.

Then, the grip motor GM1 is rotationally driven forward (ST74). When the lever detection sensor GS1 is turned off (Y in ST75), the grip motor GM1 is driven by a predetermined amount and then stopped (ST76). Thus, the driving lever 142 rotates to a position where the driving lever 142 is separate from the abutting contact portion 44*e* of the movable grip arm 44*b*. Thus, the grip arm pair 44 is opened to ungrip the sheet bundle.

Then, when the above-described grip conveying operation is completed, a staple process is carried out to staple the sheet bundle at a predetermined position as shown in FIG. 12 (ST6). Now, the staple process will be described with reference to the operation flowchart in FIG. 16. To carry out the staple process, the apparatus determines whether or not the stapling mode is the end stapling mode (ST80). At this time, if the stapling mode is the end stapling mode (Y in ST80), the staple unit 41 has already moved to one of a first staple position and a second staple position depending on the stapling mode during the staple preprocess (initial operation) in step 1 (ST1). Thus, in this state, the staple unit 41 is actuated (ST81) to staple the sheet bundle.

On the other hand, if the stapling mode is not the end stapling mode but the two-position stapling mode (N in ST80), then a unit coupling process is first carried out to couple the gripper unit 40 and the staple unit 41 together (ST83). Thus, the gripper unit 40 can move in the width direction in conjunction with movement of the staple unit 41. Thereafter, the staple motor SM is rotationally driven forward to carry out a two-position stapling process (ST84). When the staple unit 41 reaches the first staple position (Y in ST85), the staple motor SM is stopped (ST86). Then, a staple operation is performed.

When the staple operation is performed at the first staple position, the staple motor SM is rotationally driven forward again (ST87) to move the staple unit 41 to a second staple position. When the staple unit 41 reaches the second staple position (Y in ST88), the staple motor SM is stopped (ST89). Thereafter, the staple unit 41 is actuated (ST90) to perform the staple operation at the second staple position. When the staple unit 41 completes stapling the sheet bundle at the two positions, a unit decoupling process is carried out to decouple the gripper unit 40 from the staple unit 41 (ST91). The above-described first and second staple positions are preset depending on the sheet size. Those of pre-stored values which correspond to sheet size information from the image forming apparatus main body B are set so that the staple unit 41 can be controlled based on the values.

Figure 17:
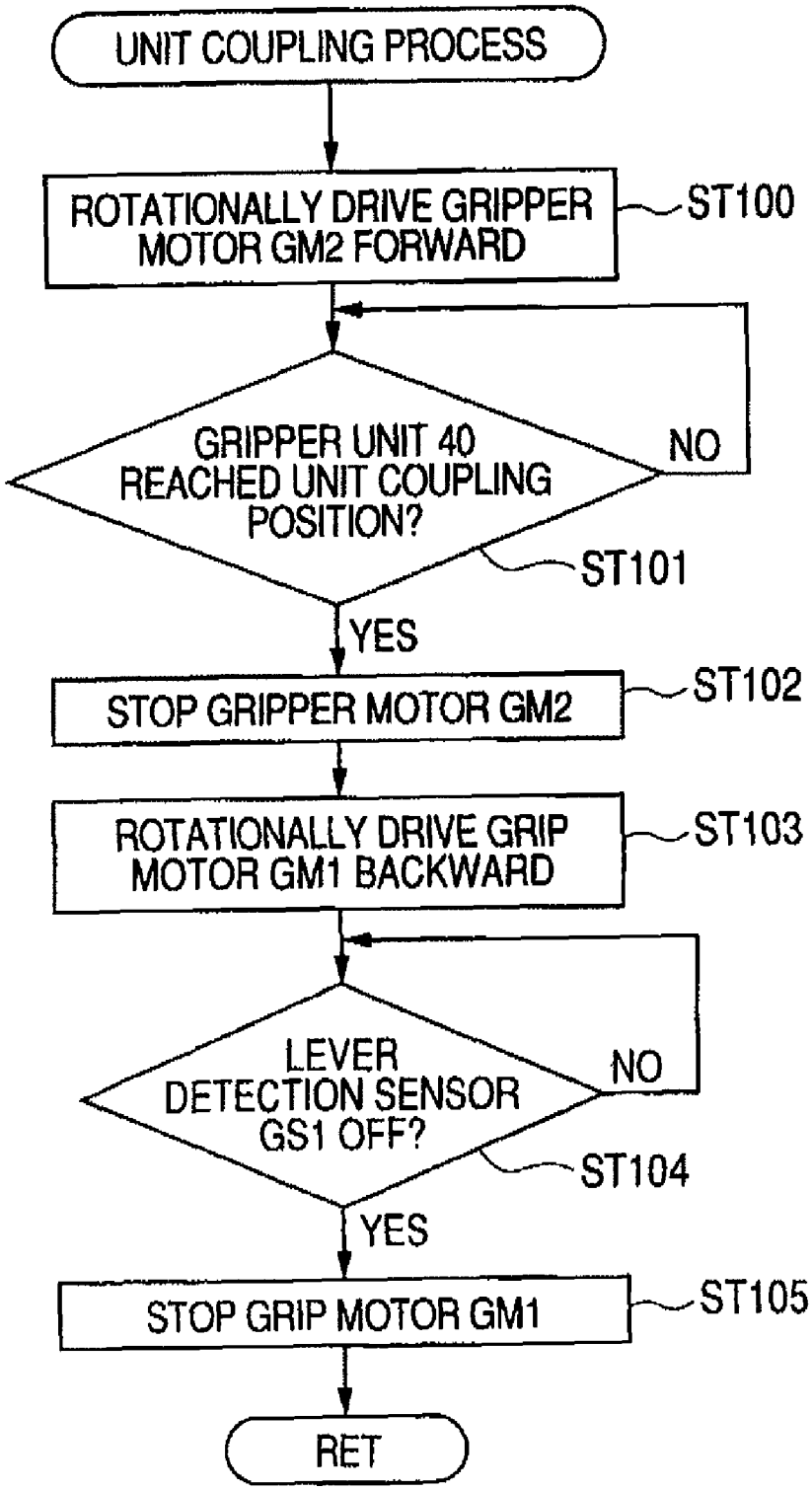
FIG. 17 is an operation flowchart illustrating unit coupling process of the sheet processing apparatus.
Figure 18:
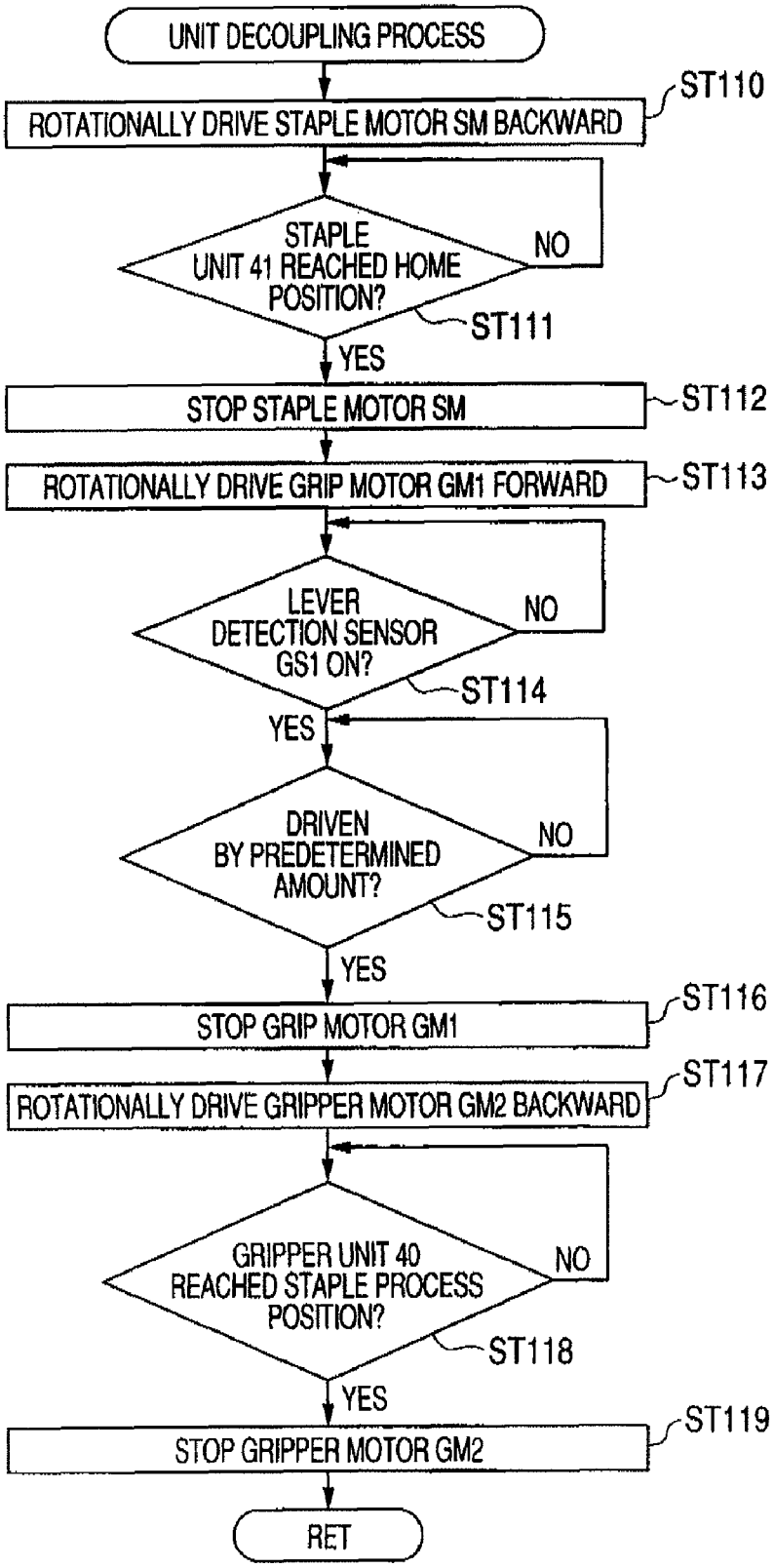
FIG. 18 is an operation flowchart illustrating a unit decoupling process of the sheet processing apparatus.
Figure 19:
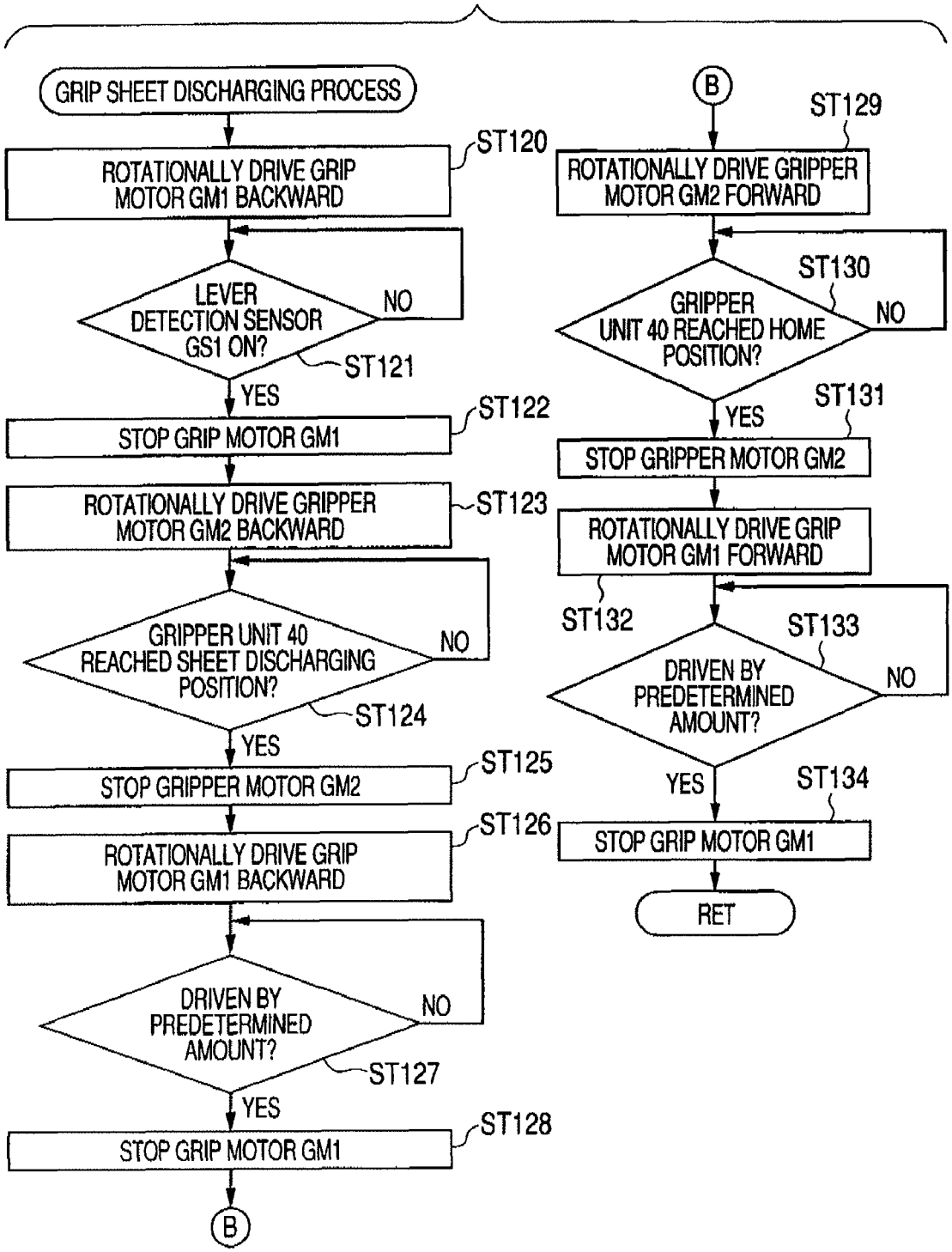
FIG. 19 is an operation flowchart illustrating a grip sheet-discharging process of the sheet processing apparatus.
Figure 20:
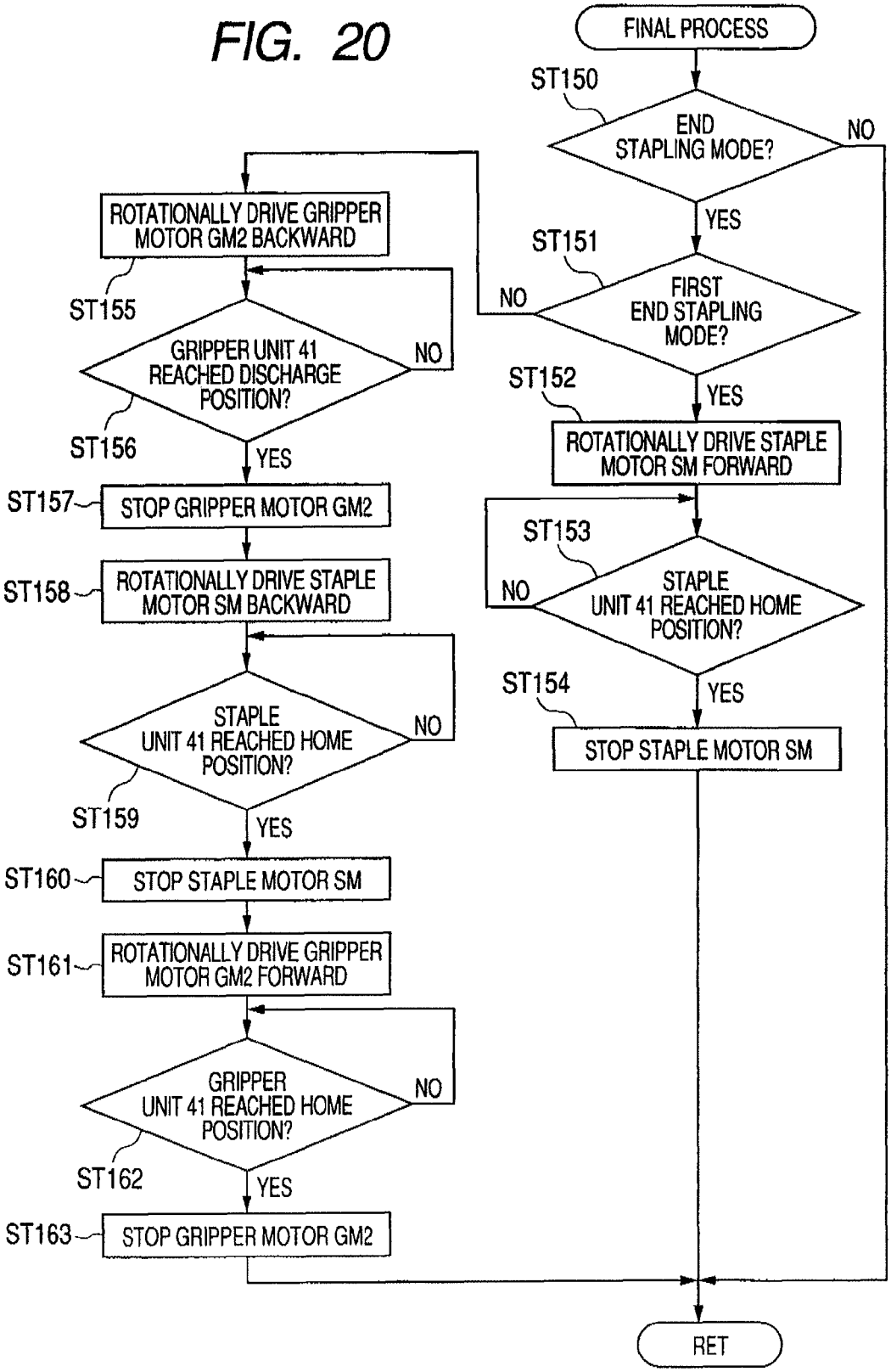
FIG. 20 is an operation flowchart illustrating a final process of the sheet processing apparatus.

Now, the unit coupling process and the unit decoupling process will be described with the operation flowchart in FIG. 17 and FIG. 18. To carry out the unit coupling process, first, the gripper motor GM2 is rotationally driven forward (ST100) to move the gripper unit 40 located in the staple process position GHP toward the unit coupling position P2 as shown in the operation flowchart in FIG. 17. At this time, the staple unit 41 moves to and stands by at a position where the staple unit 41 can be coupled to the gripper unit 40. When the gripper unit 40 moves to the unit coupling position P2 (Y in ST101), the projection 133 of the coupling member 91 enters a groove portion (not shown in the drawings) formed in the bottom surface of the engagement member 129 of the staple unit 41 as shown in FIG. 10B and FIG. 11B. Thus, the staple unit 41 and the gripper unit 40 are coupled together with respect to the width direction and can thus move integrally in the width direction. Furthermore, the tip of the swinging lever 162 of the gripper unit 40 brings into abutting contact with the engagement member 129 of the staple unit 41. Then, as shown in FIG. 11B, the gripper unit 40 is disconnected from the fourth guide rail 43*d* and can move freely in the width direction.

Then, after the staple unit 41 and the gripper unit 40 are coupled together with respect to the width direction, the gripper motor GM2 is stopped (ST102) to stop the gripper unit 40 at the unit coupling position P2. Thereafter, the grip motor GM1 is rotationally driven backward (ST103) to rotate the actuation member 131 and the detection flag 142*b* around the shaft 142*a* serving as a support point. When the detection flag 142*b* passes by to turn off the lever detection sensor GS1 (Y in ST104), the grip motor GM1 is stopped (ST105). At this time, the actuation member 131 moves the actuation pin 132*b*. In response, as shown in FIG. 10B, the engagement pin 132*a* of the coupling arm member 132 engages with the groove portion 129*a* of the engagement member 129 of the staple unit 41 moved to and standing by at the position where the staple unit 41 can be coupled to the gripper unit 40. Thus, the two units are coupled together with respect to the sheet discharging direction and can move integrally along the sheet discharging direction.

Now, the unit decoupling process will be described. The unit decoupling process is carried out as follows. As shown in the operation flowchart in FIG. 18, when the staple unit 41 staples the sheet bundle at the second position, the staple motor SM is rotationally driven backward (ST110). Thus, the staple unit 41 is moved to the home position SHP. When the staple unit 41 reaches the home position SHP (Y in ST111), the staple motor SM is stopped (ST112). Thus, the gripper unit 40 coupled to the staple unit 41 is also moved and placed in a position where the gripper unit 40 can be coupled to the fourth guide rail 43*d*.

Then, the grip motor GM1 is rotationally driven forward (ST113). When the detection flag 142*b* passes by the lever detection sensor GS1 to turn on the lever detection sensor GS1 (Y in ST114), the grip motor GM1 is driven by a predetermined amount. When the grip motor GM1 is driven by a predetermined amount (Y in ST115), the grip motor GM1 is stopped (ST116). Thus, the actuation member 131 moves the actuation pin 132*b* in the direction opposite to that during the coupling operation. As shown in FIG. 10A, the engagement pin 132*a* of the coupling arm member 132 retracts from the groove portion 129*a* of the engagement member 129. As a result, the gripper unit 40 and the staple unit 41 are decoupled from each other.

Thereafter, the gripper motor GM2 is rotationally driven backward (ST117) to move the gripper unit 40 to the staple process position. When the gripper unit 40 returns to the staple process position again (Y in ST118), the gripper motor GM2 is stopped (ST119). When the backward rotational driving of the gripper motor GM2 is started, the gripper motor GM2 and the gripper unit 40 have not reliably been coupled together. However, the sliding pin 145 of the gripper unit 40 is engaged with the groove portion of the fourth guide rail 43*d*. Thus, the gripper unit 40 moves in conjunction with movement of the fourth guide rail 43*d*. During the movement, the tip of the swinging lever 162 of the gripper unit 40 is separated from the engagement member 129 of the staple unit 41. As shown in FIG. 11A, the gripper unit 40 and the fourth guide rail 43*d* are reliably coupled together.

Then, when the above-described staple process is completed, a grip sheet-discharging process is carried out to discharge the sheet bundle onto the stack tray 51 as shown in FIG. 12 (ST7). Now, the grip sheet-discharging process will be described with reference to the operation flowchart in FIG. 19. To carry out the grip sheet-discharging process, first, the grip motor GM1 of the gripper unit 40 located in the staple process position is rotationally driven backward (ST120). Then, when the lever detection sensor is turned on (Y in ST121), the grip motor GM1 is stopped (ST122). Thus, the sheet bundle is gripped by the grip arm pair 44.

Then, when the grip arm pair 44 grips the sheet bundle, the gripper motor GM2 is rotationally driven backward (ST123). Thus, the gripper unit 40 moves toward the housing section 10. When the gripper unit 40 reaches the sheet discharging position P3 shown in FIG. 3 (Y in ST124), the gripper motor GM2 is stopped (ST125). Then, the grip motor GM1 is rotationally driven backward with the gripper unit 40 located in the sheet discharging position (ST126). Thus, the first gripper unit 40*a* is moved toward the stack tray 50. Thereafter, the grip motor GM1 is rotationally driven backward by a predetermined amount (Y in ST127) and then stopped (ST128).

Figure 21A:
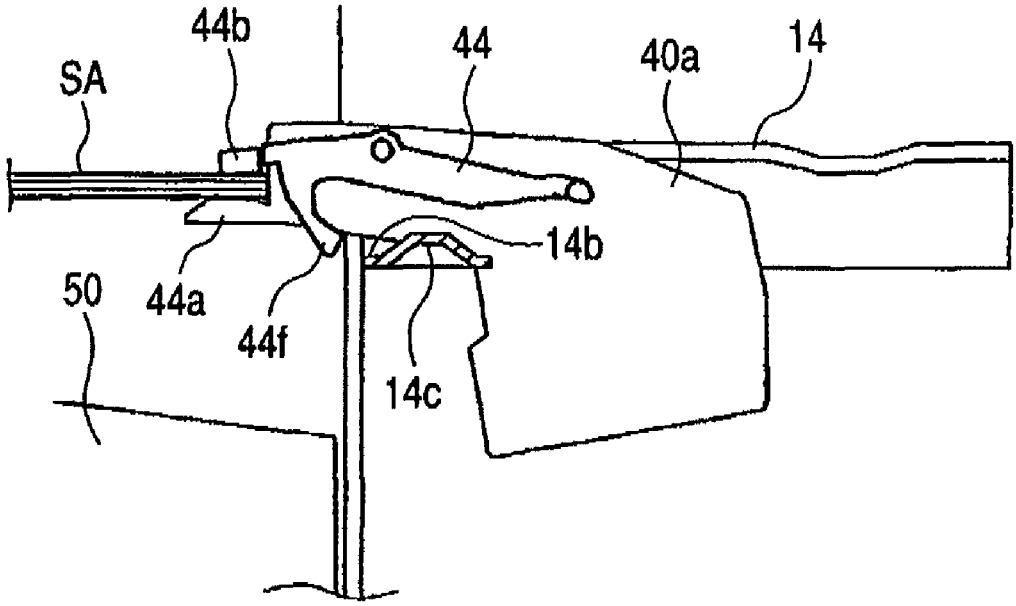
FIGS. 21A and 21B are diagrams illustrating a sheet bundle housing operation of the sheet processing apparatus.

In the exemplary embodiment, a cutout (not shown in the drawings) extending in the sheet discharging direction is formed in the processing tray 14. As shown in FIG. 21A, the cutout allows the grip sections 44*c* and 44*d* of the grip arm pair 44 to move from a position on the processing tray 14 to a position above the stack tray 50 and below the loading end surface of the processing tray 14. Thus, the sheet bundle SA moves onto the stack tray 50.

Figure 21B:
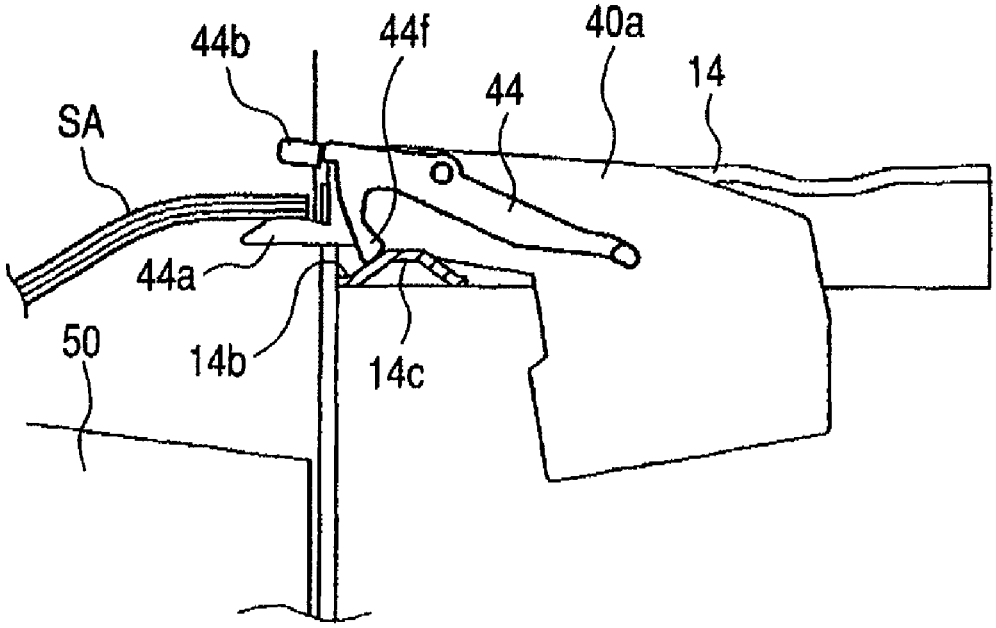

Then, when the first gripper unit 40*a* conveys the sheet bundle SA onto the stack tray, the grip motor GM2 is rotationally driven forward (ST129) to move the first gripper unit 40*a* in a direction different from the one toward the stack tray, that is, move the first gripper unit 40*a* toward the home position. When the first gripper unit 40*a* is thus moved, the protruding portion 44*f* of the gripper arm 44 brings into abutting contact with the guide piece 14*c* provided on a folded portion 14*b* folded from the cutout in the processing tray 14. Thus, as shown in FIG. 21B, the movable grip arm 44*b* moves away from the fixed grip arm 44*a* to ungrip the sheet bundle SA. As a result, the sheet bundle is housed on the stack tray 50.

Thereafter, when the gripper unit 40 reaches the home position (Y in ST130), the gripper motor GM2 is stopped (ST131). Then, the grip motor GM1 is rotationally driven forward (ST132). The grip motor GM1 is driven by a predetermined amount to return the first gripper unit 40*a* to a predetermined position. Thus, the grip arm pair 44 of the first gripper unit 40*a* moves above the loading surface of the processing tray 14. The grip motor GM1 is driven by a predetermined amount (Y in ST133) and then stopped (ST134).

Then, when the above-described sheet bundle grip sheet-discharging process is completed, as shown in FIG. 12, the apparatus determines whether or not the set copy count received from the image forming apparatus main body B has been reached (ST8). If the set copy count has not been reached (N in ST8), ST3 to ST8 in FIG. 12 are repeatedly carried out.

On the other hand, if the set copy count has been reached (Y in ST8), the final process is carried out to allow the sheet processing apparatus C to be stopped (ST9). Now, the final process will be described with reference to the operation flowchart in FIG. 20.

In the final process, an operation is performed to return the conveying roller 21, the discharge roller 22, the stopper member 31, and the like to the respective initial states. If the stapling mode is the end stapling mode, a process is carried out to move the staple unit 41 from the staple position to the home position.

In this process, if the stapling mode is the end stapling mode (Y in ST150), the apparatus determines whether or not the end stapling mode is the first end stapling mode (ST151). If the stapling mode is the first end stapling mode (Y in ST151), the staple motor SM is rotationally driven forward (ST152). Thus, the staple unit 41 moves toward the home position. When the staple unit 41 reaches the home position (Y in ST153), the staple motor SM is stopped (ST154).

On the other hand, if the stapling mode is the second end stapling mode (N in ST151), the gripper motor GM2 is rotationally driven backward (ST155). Thus, the gripper unit 40 moves toward the sheet discharging position. When the gripper unit 40 reaches the sheet discharging position (Y in ST156), the gripper motor GM2 is stopped (ST157). Thus, the guide rail section R is formed in which the first guide rail 42*a* is continuous with the second and third guide rails 42*b* and 42*c*. Then, the staple motor SM is rotationally driven backward (ST158) to move the staple unit 41 toward the home position. When the staple unit 41 reaches the home position (Y in ST159), the staple motor SM is stopped (ST160). Thereafter, the gripper motor GM2 is rotationally driven forward (ST161) to move the gripper unit 40 toward the home position. When the gripper unit 40 reaches the home position (Y in ST162), the gripper motor GM2 is stopped (ST163). When the above-described final process is finished, the staple operation of the sheet processing apparatus C is finished.

Here, in the exemplary embodiment, a detection sensor is provided at each of the stop positions including the staple process position (home position), the grip position, the sheet discharging position, and the coupling position, to determine whether or not the gripper unit 40 has reached the stop position. Of course, it may be possible that the detection of the arrival of the gripper unit 40 at respective stop positions is performed by storing the number of driving pulses of the gripper motor GM2 which number corresponds to the distances among the respective stop positions and then making a count of the number of the driving pulses.

The detection sensors arranged at the respective positions are also used for movement of the staple unit 41 to the first and second staple positions in the first and second end stapling modes and for movement of the staple unit 41 to the home position. Furthermore, movement to the position where the staple unit 41 can be coupled to the gripper unit 40 in the two-position stapling mode as well as movement to the first and second staple positions may be controlled as follows. The travel distance of the staple unit 41 is calculated according to the sheet size. The number of driving pulses set based on the calculation result is counted. Then, based on the counted number of driving pulses, the staple unit 41 is stopped at the position where the staple unit 41 can be coupled to the gripper unit 40 and at the first and second staple positions.

As described above, in the exemplary embodiment, the fourth guide rail 43*d* supports the gripper unit 40 so that the gripper unit 40 can be moved in the same direction as that in which the coupled staple unit 41 moves. Thus, in plural-position stapling, the gripper unit 40 can be moved integrally with the staple unit 41 coupled to the gripper unit 40 at the coupling position. Hence, the staple unit 41 can be moved to the stapling position without the need for a special retract space. That is, if the staple unit 41 is moved to the movement area in which the gripper unit 40 moves in the discharge direction, before stapling sheets, the gripper unit 40 is retracted in the width direction so as to avoid obstructing the movement of the staple unit 41 to the movement area. If the staple unit 41 staples the sheets outside the movement area, the gripper unit 40 avoids moving in the width direction. Thus, the staple unit 41 can be moved to the stapling position without the need for a special retract space in which the gripper unit 40 is retracted. In the exemplary embodiment, the gripper unit 40 is moved in the width direction by the first moving mechanism operating the staple unit 41. However, in conjunction with movement of the staple unit 41 to the movement area, the gripper unit 40 may be retracted in the width direction by a moving mechanism different from the first moving mechanism.

In other words, in the exemplary embodiment, a common movement area overlapping the movement area of the staple unit 41 is provided on the upstream side, in the discharge direction, of the movement area in which the gripper unit 40 moves in the discharge direction. When the staple unit 41 moves from an area other than the common movement area, that is, a widthwise area other than the common movement area, in order to carry out the stapling process, the gripper unit 40 is moved in the same direction as that in which the staple unit 41 moves. Thus, the staple unit 41 can be moved to the stapling position without the need to provide a special retract space into which the gripper unit 40 is retracted.

If the staple unit 41 staples sheets in an area other than the common movement area, the gripper unit 40 discharges the stapled sheets onto the first or second stack tray 50 or 51 without moving in the direction in which the staple unit 41 can move. Furthermore, if the staple unit 41 staples the sheets in the common movement area, the staple unit 41 moves to an area other than the common movement area after stapling the sheets. In conjunction with the movement of the staple unit 41, the gripper unit 40 moves to the common movement area and then discharges the stapled sheets onto the first or second stack tray 50 or 51.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-211126, filed Sep. 11, 2009, and 2010-161369 filed Jul. 16, 2010 which are hereby incorporated by reference herein in their entirety.

What is claimed is:

1. A sheet processing apparatus comprising:

a processing tray on which sheets to be conveyed in a predetermined discharge direction are stacked;

a stapling apparatus which staples an upstream side, in the discharge direction, of the sheets stacked on the processing tray and is configured to be movable in a width direction crossing the discharge direction, along the upstream side of the sheets stacked on the processing tray;

a gripping apparatus which grips the upstream side of the sheets stapled by the stapling apparatus and is configured to be movable in the discharge direction and in the width direction; and a control section controlling the movements of the stapling apparatus and the gripping apparatus, wherein the control section controls the gripping apparatus to be retracted in the width direction if the control section controls the stapling apparatus to staple the sheets in a movement area for the gripping apparatus in the discharge direction, and wherein the control section controls the gripping apparatus to avoid retracting in the width direction if the control section controls the stapling apparatus to staple the sheets outside the movement area.

2. The sheet processing apparatus according to claim 1, wherein the control section controls the gripping apparatus to move and discharge the stapled sheets in the discharge direction without moving in the width direction if the control section controls the stapling apparatus to staple the sheets outside the movement area, wherein the control section controls the stapling apparatus to staple the sheets and then move out from the movement area, and wherein the control section controls the gripping apparatus to move to the movement area and then move and discharge the stapled sheets in the discharge direction if the control section controls the stapling apparatus to staple the sheets in the movement area.

3. The sheet processing apparatus according to claim 1, further comprising a support member supporting the gripping apparatus, wherein the support member is configured to be movable to a discharge position where the gripping apparatus discharges the sheets and to a coupling position where the gripping apparatus is coupled to the stapling apparatus, integrally with the gripping apparatus, and the support member supports the gripping apparatus coupled to the stapling apparatus at the coupling position so that the gripping apparatus is movable in the same direction as that in which the stapling apparatus is moved by the control section.

4. The sheet processing apparatus according to claim 3, wherein the support member guides the movement, along the upstream side of the sheets, of the stapling apparatus coupled to the gripping apparatus at the coupling position.

5. The sheet processing apparatus according to claim 3, wherein the apparatus is operable in a plural-position stapling mode in which the upstream side of the sheets is stapled at a plurality of positions and an end stapling process mode in which the sheets is stapled at one side end thereof, wherein in a case that the plural-position stapling mode is selected and the stapling apparatus is moved from the position where the sheets are stapled at one side end to the position where the sheets are stapled at a plurality of positions, the gripping apparatus is placed at the coupling position and moved in the same direction as that in which the stapling apparatus moves.

6. The sheet processing apparatus according to claim 1, further comprising a coupling section coupling the stapling apparatus and the gripping apparatus together, wherein the coupling section includes a first coupling mechanism coupling the gripping apparatus and the stapling apparatus in the discharge direction and a second coupling mechanism coupling the gripping apparatus and the stapling apparatus in the width direction crossing the discharge direction.

7. The sheet processing apparatus according to claim 6, wherein the coupling section is actuated when the gripping apparatus moves to the coupling position, to couple the gripping apparatus and the stapling apparatus together.

8. An image forming apparatus comprising:

an image forming section forming an image on a sheet, and the sheet processing apparatus according to claim 1, for processing the sheet with the image formed thereon by the image forming section.

9. A sheet processing apparatus comprising:

a processing tray on which sheets to be conveyed in a predetermined discharge direction are stacked;

a stapling apparatus which staples an upstream side, in the discharge direction, of the sheets stacked on the processing tray, and is configured to be movable in a width direction crossing the discharge direction, along the upstream side of the sheets stacked on the processing tray;

a gripping apparatus which grips the upstream side of the sheets stapled by the stapling apparatus, and is configured to be movable in the discharge direction and the width direction crossing the discharge direction; and a control section controlling the movements of the stapling apparatus and the gripping apparatus, wherein the control section controls the gripping apparatus to be retracted in the width direction if the control section controls the stapling apparatus to staple the sheets in a movement area for the gripping apparatus in the discharge direction, and wherein the control section controls the stapling apparatus, irrespective of the gripping apparatus, to move to a stapling position if the control section controls the stapling apparatus to staple the sheets outside the movement area.

* * * * *